US006892718B2

(12) United States Patent
Tiberius et al.

(10) Patent No.: US 6,892,718 B2
(45) Date of Patent: May 17, 2005

(54) PAINTBALL, HANDGUN, AUTOMATIC MAGAZINE

(76) Inventors: Benjamin T. Tiberius, 564 Hillside Cir., Alpine, UT (US) 84004; Dennis E. Tiberius, 564 Hillside Cir., Alpine, UT (US) 84004; Kyle L. Hansen, 1239 West 1480 N., Orem, UT (US) 84057

( * ) Notice: Subject to any disclaimer, the term of this patent is extended or adjusted under 35 U.S.C. 154(b) by 0 days.

(21) Appl. No.: 10/791,436

(22) Filed: Mar. 2, 2004

(65) Prior Publication Data

US 2004/0200467 A1 Oct. 14, 2004

Related U.S. Application Data

(63) Continuation of application No. 10/281,851, filed on Oct. 28, 2002, now Pat. No. 6,701,909, which is a continuation of application No. 09/541,786, filed on Oct. 29, 2002, now Pat. No. 6,470,872.

(51) Int. Cl.[7] ..... F41B 11/06

(52) U.S. Cl. ..... 124/74; 124/56; 42/49.01

(58) Field of Search ..... 124/72, 73, 74; 42/49.01, 49.02, 50

(56) References Cited

U.S. PATENT DOCUMENTS

| | | | | | |
|---|---|---|---|---|---|
| 2,357,951 | A | | 9/1944 | Hale | 124/72 |
| 2,526,018 | A | | 10/1950 | Foster et al. | 124/73 |
| 2,885,811 | A | * | 5/1959 | Womble, Jr. | 42/50 |
| 3,143,819 | A | * | 8/1964 | Stevens, Jr. | 42/50 |
| 3,205,604 | A | * | 9/1965 | Plumer | 42/50 |
| 3,453,762 | A | * | 7/1969 | Fremont | 42/50 |
| 3,572,310 | A | | 3/1971 | Chiba | 124/76 |
| 3,732,643 | A | * | 5/1973 | Wells | 42/50 |
| 3,854,376 | A | * | 12/1974 | Elmore et al. | 89/33.1 |
| 3,888,159 | A | * | 6/1975 | Elmore et al. | 89/7 |
| 3,964,199 | A | * | 6/1976 | Musgrave | 42/50 |

(Continued)

*Primary Examiner*—Teri P. Luu
*Assistant Examiner*—Troy Chambers
(74) *Attorney, Agent, or Firm*—Pate Pierce & Baird

(57) ABSTRACT

A paintball gun is sized and designed to appear like and operate in a manner similar to a conventional handgun. A removable magazine stores projectiles and propellant. The entire magazine is small enough to fit into a handle of a pistol. The magazine may be integrated with propellant and projectile portions locked together or separable. Standard carbon dioxide cartridges fit within the magazine. Paintballs may be staggered to increase the maximum magazine load. A user may selectively release just the projectile portion of the magazine, in order to leave the propellant undisturbed until fully expended. The magazine can be completely removed without substantial loss of propellant.

20 Claims, 19 Drawing Sheets

U.S. PATENT DOCUMENTS

| | | | | | |
|---|---|---|---|---|---|
| 4,004,566 | A | | 1/1977 | Fischer | 124/59 |
| 4,137,893 | A | * | 2/1979 | Beauchamp | 124/72 |
| 4,329,802 | A | * | 5/1982 | Coonan | 42/50 |
| 4,514,922 | A | * | 5/1985 | Farrar et al. | 42/50 |
| 4,563,937 | A | * | 1/1986 | White | 89/185 |
| 4,872,279 | A | * | 10/1989 | Boat | 42/90 |
| 4,970,818 | A | | 11/1990 | Vecchieschi | 42/50 |
| 4,995,179 | A | * | 2/1991 | Switzer | 42/50 |
| 5,081,778 | A | * | 1/1992 | Switzer | 42/50 |
| 5,113,604 | A | * | 5/1992 | Vyprachticky | 42/50 |
| 5,113,605 | A | * | 5/1992 | Kim | 42/50 |
| 5,280,778 | A | | 1/1994 | Kotsiopoulos | 124/73 |
| 5,291,679 | A | * | 3/1994 | Wollack et al. | 42/50 |
| 5,309,660 | A | | 5/1994 | Blackmore | 42/50 |
| 5,450,683 | A | | 9/1995 | Miller | 42/50 |
| 5,477,843 | A | | 12/1995 | Kunimoto | 124/73 |
| 5,505,188 | A | | 4/1996 | Williams | 124/74 |
| 5,542,406 | A | | 8/1996 | Oneto | 124/73 |
| 5,561,258 | A | | 10/1996 | Bentley et al. | 89/33.17 |
| 5,561,933 | A | * | 10/1996 | Czekalski | 42/18 |
| 5,568,696 | A | * | 10/1996 | Mauch et al. | 42/49.02 |
| 5,664,552 | A | | 9/1997 | Kunimoto | 124/73 |
| 5,669,369 | A | | 9/1997 | Scott | 124/73 |
| 5,697,179 | A | * | 12/1997 | Vanmoor | 42/87 |
| 5,704,342 | A | | 1/1998 | Gibson et al. | 124/73 |
| 5,711,286 | A | * | 1/1998 | Petrosyan et al. | 124/73 |
| 5,771,875 | A | | 6/1998 | Sullivan | 124/72 |
| 5,839,422 | A | | 11/1998 | Ferris | 124/53.5 |
| 5,842,300 | A | * | 12/1998 | Cheshelski et al. | 42/116 |
| 5,845,426 | A | * | 12/1998 | Valorose | 42/49.02 |
| 5,913,303 | A | | 6/1999 | Kotsiopoulos | 124/31 |
| 6,073,620 | A | | 6/2000 | Kunimoto | 124/74 |
| 6,112,734 | A | | 9/2000 | Kunimoto | 124/73 |
| 6,158,424 | A | * | 12/2000 | Kunimoto | 124/73 |
| 6,257,115 | B1 | * | 7/2001 | Balsavage et al. | 89/33.1 |
| 6,470,872 | B1 | | 10/2002 | Tiberius et al. | 124/74 |
| 6,497,229 | B1 | | 12/2002 | Maeda | 124/76 |
| 6,701,909 | B2 | | 3/2004 | Tiberius et al. | 124/74 |

* cited by examiner

PAINTBALL, HANDGUN, AUTOMATIC MAGAZINE

RELATED APPLICATIONS

This application is a continuation of my application Ser. No. 10/281,851, filed on Oct. 28, 2002, which will issue as U.S. Pat. No. 6,701,909 on Mar. 9, 2004, which is a continuation of Ser. No. 09/541,786, now U.S. Pat. No. 6,470,872, issued Oct. 29, 2002.

BACKGROUND

1. The Field of the Invention

This invention relates to paintball guns and, more particularly to novel systems and methods for feeding propellant and ammunition.

2. The Background Art

Paintball tag or combat has become a recreational activity favored by many players old and young. Paintball guns launch projectiles made of biodegradable, gelatinous shells surrounding a powder or paint content. Guns are carried in a manner similar to actual weapons, but typically cannot be fired as such.

Conventional paintball guns often operate similar to a fire hose. That is, so long as a trigger mechanism is engaged, by a user, a stream of balls is fed from a large hopper into the barrel of the gun. Meanwhile, a rather unwieldy canister containing compressed gas is carried on a belt, pack, or the like, by a user, to be released in a stream by a trigger. Accordingly, paintball guns appear to operate more like hoses than guns. Very little control is available over the expenditure of paintballs and compressed gas. Moreover, accuracy, conservation of ammunition, handling, and the like, are not similar to the same functions for conventional weapons. Moreover, the segregation of the gas supply and launcher (gun) tends to interfere with the overall sense of balance, operation, utility, aiming, and the like for paintball weapons.

What is needed is a paintball gun designed to look, feel, weigh, and operate very similarly to an actual weapon. Thus, integration of a gas supply within a weapon, making ammunition clips reloadable and exchangeable in a reasonable size, triggering, maximum loads, and so forth are all objectives to be met by a paintball gun suitable for replicating or approaching actual weapons.

Mechanisms for operating paintball guns may be designed in a variety of ways. One may design a lock or action of a gun to use gas from a compressed gas source to discharge projectiles. Another quantity of the same compressed gas may be used to actuate a firing mechanism, returning a trigger and actuation system to a ready-to-fire position.

One may also use a trigger mechanism to actuate multiple mechanisms. A trigger may actuate a valving system controlling and directing the flow of compressed gas as a propellant. Similarly, a gun trigger may provide catching and releasing a feed mechanism for paintballs.

What is needed is a mechanism for providing a firing bolt. The firing bolt should simultaneously control delivery of gas, including any porting, discharge, sealing, and the like, while also loading a projectile into a barrel for firing. It would be an advance in the art if a mechanism could be designed such that upon firing, a bolt automatically returns to a ready-to-fire position by virtue of a return mechanism other than consumption of additional compressed propellant.

It would be a further advance in the art to provide a gun trigger with a function requiring only selected catching and releasing of such a firing bolt. In such a mechanism, compressed propellant (e.g. gas) could be used for the single purpose of firing the projectile, with loading occurring automatically as part of the sequence. Thus, the entire mechanical workings of a gun may be greatly simplified while the efficiency of use of compressed propellant would require smaller containers therefor.

It would be a major advance in the art to combine an ammunition magazine in a single "clip." Prior art systems contain a plumbing apparatus for storing compressed propellant and delivering it to a launcher (e.g. gun), operating much like a hose or piping system.

Meanwhile, massive hoppers drain a seemingly unending stream of paintballs into the flow path of the gas, launching them like so many beads in a chain. It would be a substantial advance in the art to provide a gun having sufficiently small requirements for propellant that a compact canister of propellant could be carried and maintained within the envelope typically associated with a conventional gun magazine. Moreover, it would be a major advance in the art to combine a clip of projectiles and compressed propellant into a single magazine, providing for quick reloading of the entire magazine with a single set of coordinated motions. Thus, having a clip or magazine containing both propellant and projectiles would be more nearly replicate the experience of loading and firing a conventional weapon. Thus, such an improved device may be most beneficial in training and simulation for law enforcement agencies.

BRIEF SUMMARY AND OBJECTS OF THE INVENTION

In view of the foregoing, it is a primary object of the present invention to provide an apparatus and method for launching projectiles using a compressed gas as a propellant, the entire apparatus being sized and operable consistent with conventional guns.

It is an object of the invention to provide an apparatus and method in which an integrated magazine and gun are provided within the envelope conventionally associated with actual guns.

It is an object of the invention to provide a simplified trigger actuation apparatus and method tending to operate a gun in a manner consistent with conventional guns.

It is a further object of the invention to provide a ready mechanism for replacing magazines.

It is a further object of the invention to provide a magazine that integrates propellant and projectiles in a unit that can be handled by a user in a manner consistent with conventional guns.

It is an object of the invention to provide careful control of gas discharge from a propellant reservoir in order to reduce the requirements for propellant, and thus reduce the size of a propellant source required for an apparatus and method in accordance with the invention.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include a gun having a firing bolt. The firing bolt may be propelled down range within the gun by air pressure or other propellant from an air or gas chamber.

A catch may hold the firing bolt against moving, thus locking the bolt into a ready-to-fire position until activated by a trigger. In certain embodiments, a bolt catch may engage a matched portion of a firing bolt to lock a bolt in place. Upon actuation of a trigger, the firing bolt disengages from the catch, freeing the bolt to travel down range as a firing mechanism of the gun. Also, upon movement of the bolt forward, a valving mechanism associated with the bolt releases gas urging the bolt forward, the gas passing through the bolt and into the barrel of a gun, accelerating a projectile (e.g. paintball) down the barrel.

In certain embodiments, a system of springs and catches returns the bolt and trigger mechanisms to their original, ready-to-fire positions. In certain embodiments, an ammunition magazine may contain a canister or cartridge holding compressed gas or other propellant (e.g. liquid, saturated liquid, or gas) maintained under pressure for propelling projectiles from the gun. In certain embodiments, a magazine may be removable from the gun without discharging remaining propellant from the storage cartridge.

In alternative embodiments, the magazine may be designed to operate as a single, monolithic unit, yet to be separable between the propellant and the projectiles. For example, a carbon dioxide cartridge may be used, and will typically contain 12 grams of carbon dioxide. About 25–30 rounds of ammunition may be fired with 12 grams of carbon dioxide. However, a magazine for a pistol is usually stored in the handle of the gun. In such a configuration, space constraints may limit a magazine to approximately 10 rounds of projectiles. In order to effectively use all of the available propellant, a user may remove the magazine and reload the projectiles approximately three times for each reloading of a propellant cartridge. In one embodiment, the entire magazine may be retrieved from the gun and the propellant may automatically seal.

However, a change in air pressure may result in a chill inside the gun. That is, rapidly expanding gases left behind within the gun, may chill seals, or condense vapors, resulting in failure of operations of a gun. Stable thermodynamics may be achieved by minimizing the number of pressure drops to which the various chambers of a gun may be exposed. Accordingly, in one embodiment, the magazine may be handled as a unit, but the projectile magazine may be separated at will. Accordingly, the propellant portion and the ammunition portions may be loaded together, but one portion of the load (e.g. projectiles, propellant) may be loaded while leaving the other unmolested.

In certain embodiments, an apparatus (gun) may have a frame, an action (the lock), a magazine, a trigger assembly, a barrel, and the like. The gun may be made in several pieces, which may be sealed together as necessary, and removably sealed as prudent. An air chamber may provide a cavity for holding a charge of propellant (e.g. carbon dioxide, air, etc.). Ammunition may feed into a chamber to be launched down a barrel of the gun.

Suitable seals and actuators may seal a bolt in various positions, with the propellant advancing the bolt, upon actuation by a trigger, and the bolt releasing suitable quantities of propellant in order to launch the projectiles. The bolt may be driven by propellant forward, and backward. However, in certain embodiments, the bolt may be driven forward by propellant, but returned by a spring storing part of the energy of actuation of the bolt.

A magazine may include a receiver for holding a canister of propellant as a source of energy for launching projectiles. The propellant canister may be resealable by a valving system, thus tolerating removal without losing the charge of propellant in the canister. A series of valves, poppets, seals, springs, and the like, as well as a network of passages, may guide propellant gases from a magazine to the action of the gun. In certain embodiments, a head seal and tail seal may seal the valving portion or rod associated with a bolt.

Meanwhile, a trigger may actuate the bolt, launching both the bolt and its valving mechanism for a brief excursion into the chamber of the gun. As the bolt moves forward, the valving mechanism can shut off any further flow, thus discharging a limited amount of propellant with each shot. The trigger mechanism may include a simple release, but may include a comparatively sophisticated sear and latching mechanism for retaining the bolt in a ready-to-fire position. The sear may be selectively released by a trigger actuated by a user. Various spring mechanisms may return the sear to a ready-to-fire position, capturing the bolt upon return of the bolt from a fired position.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 17B, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
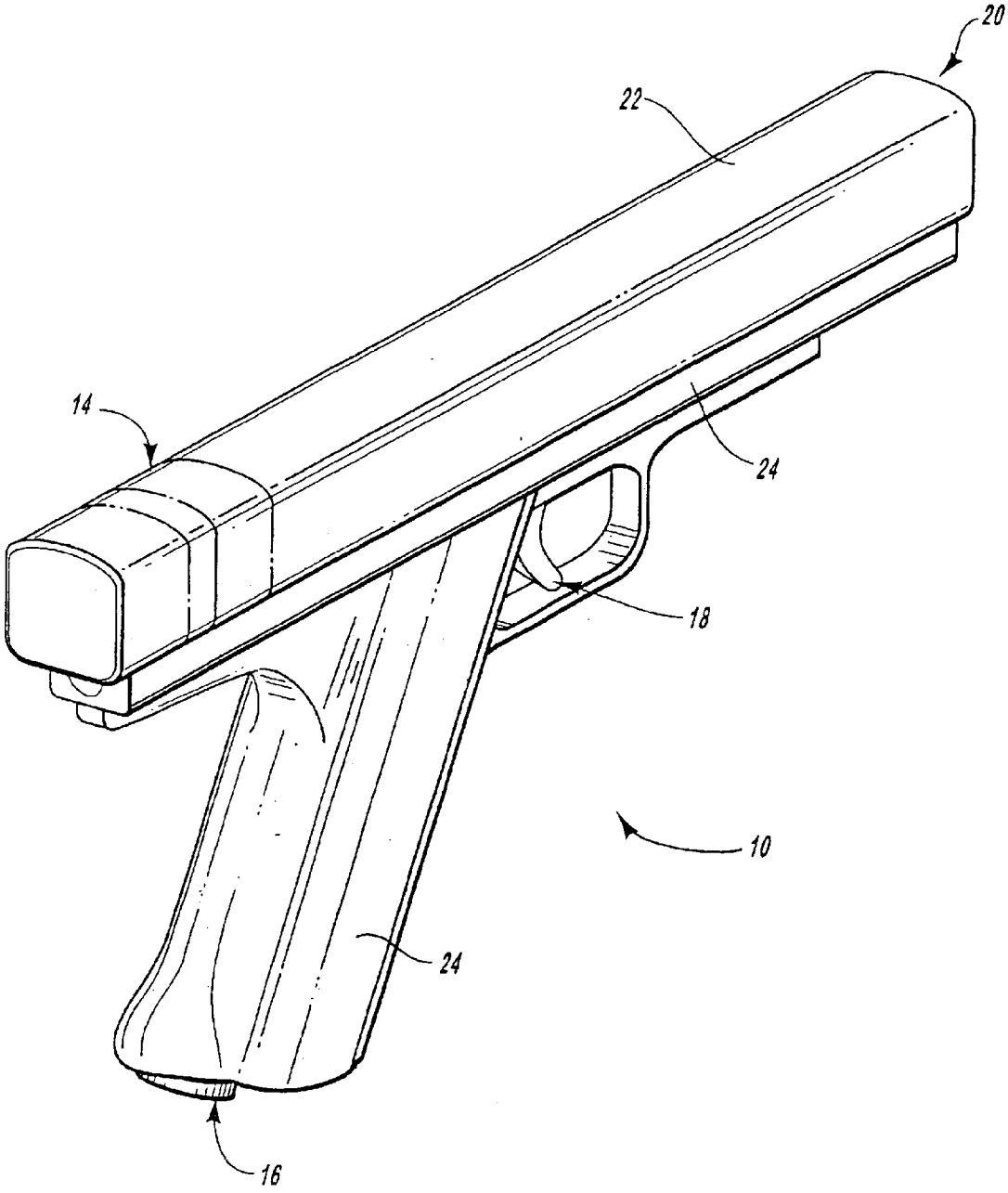
FIG. 1 is a perspective view of one embodiment of an apparatus in accordance with the invention.
Figure 2:
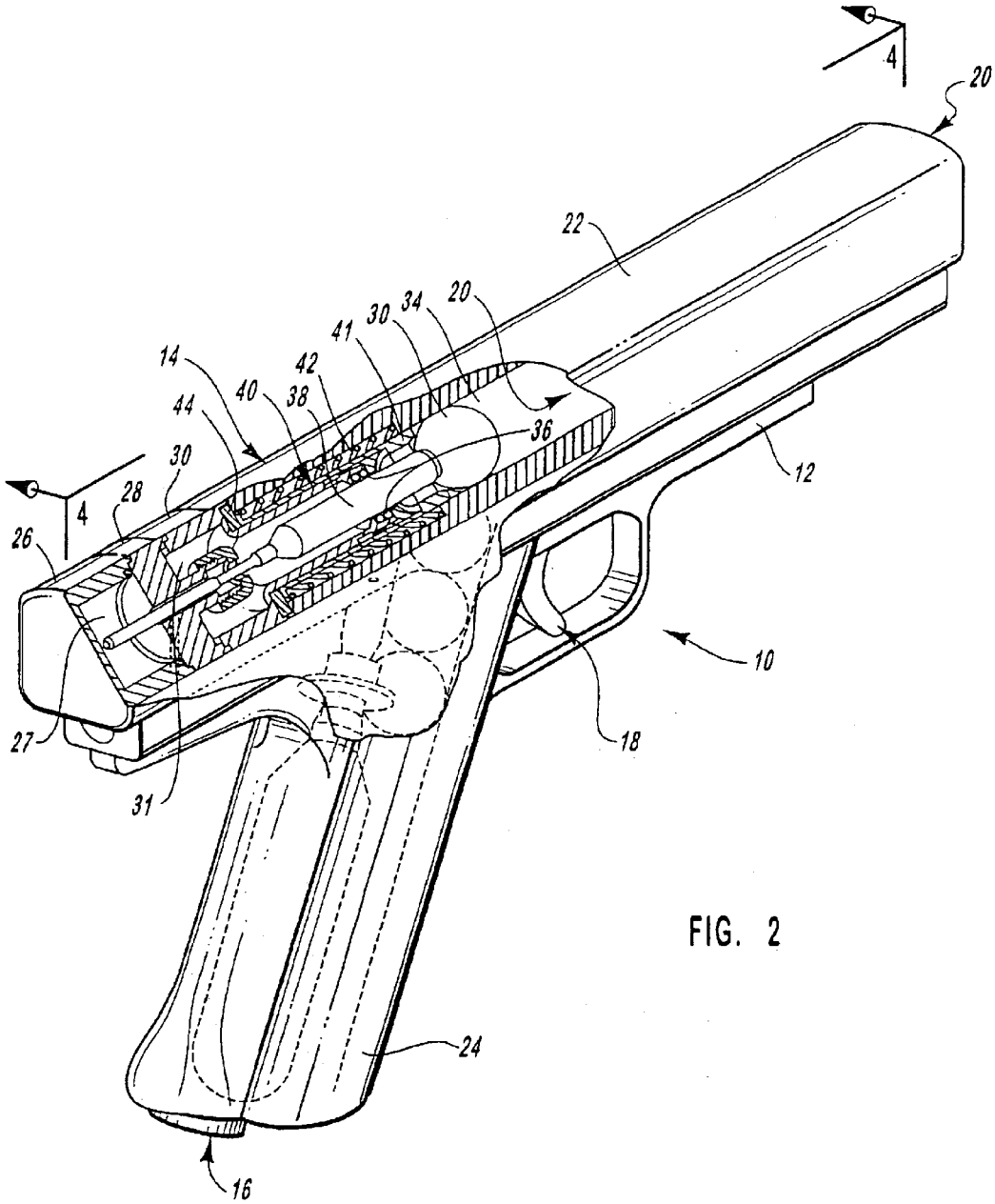
FIG. 2 is a partially cutaway and partially hidden-view rendering of a perspective view of one embodiment of the apparatus in FIG. 1.

Referring to FIG. 1, specifically, while referring to FIGS. 1–17, generally, an apparatus 10 or gun 10 may be formed to have a frame 12. The frame 12 may also be referred to as a housing 12 in an apparatus 10 in accordance with the invention. That is, since the gun 10 need not sustain the ballistic pressures typical of actual firearms, manufacturing liberties may be taken in the construction of various aspects of the gun 10. One of those liberties may involve treating the frame 12 simply as a housing 12 for various components. Accordingly, apertures, ways, grooves, openings, penetrations, and the like, may be formed in the frame 12 in order to accommodate various aspects of the gun 10.

In general, a gun 10 may include an action 14 or lock 14. The action 14 is responsible for loading and firing projectiles.

The gun 10 may include a magazine 16 integrated within the gun 10 itself. Unlike previous attempts to launch paintballs and the like, a magazine 16 may fit entirely within the envelope of the gun 10. Attached to the frame 12, or formed within the frame 12, a barrel 20 may serve to receive and launch projectiles. Independent from the frame 12, housings 22 may be formed around various aspects of the gun 10 in order to provide characteristic shapes, covers, shrouds, and the like.

Either integrated or attached to the frame 12, a handle 24 or grip 24 may serve for supporting the gun 10 in a hand of a user. Although a sidearm is illustrated, the gun 10 may be embodied in a rifle or other weapon configuration as desired.

Referring to FIGS. 2–5, while continuing to refer generally to FIGS. 1–17, a gun 10 may be formed to have an enclosure 26 proximate a back end thereof for either hiding, protecting, or pressurizing an internal cavity 27. Integrated with the enclosure 26, or as a separable piece distinct therefrom, a guide 28 may serve as a wall 28 for the cavity 27, as well as for guiding various components of the gun 10.

In general, a propellant chamber 30 may surround a cavity 31 for receiving a predetermined charge of propellant. The propellant may be compressed air, compressed carbon dioxide, pressurized propane, or other material. In certain embodiments, steam, alcohol, or other materials may be selected as a propellant. As a practical matter, propellants should provide sufficient, but limited, quantities of energy suitable for firing projectiles without substantial risk of injury to a targeted person.

A projectile 32 or ammunition 32 may typically be a gelatinous capsule containing a readily releasable pigment. For example, paintballs 32 contain a marker of highly pigmented liquid. The projectiles 32 may be formed in various shapes. Since the gun 10 has a magazine 16 capable of feeding individual projectiles, then riflings, shaped projectiles 32, and the like may be practicable.

Between the magazine 16 and the chamber 34 associated with the barrel 20 of the gun 10, an aperture 33, sometimes referred to as a feed aperture 33, connects a column of projectiles 32 between the magazine 16 and the chamber 34. The chamber 34, in contrast to the chamber 31 (propellant chamber or air chamber), corresponds to a chamber 34 of a conventional arm. Due to the fit of a projectile 32 within the barrel 20, or bore 20, the chamber portion 34 may simply be an extension of the barrel 20. However, in certain embodiments, mechanisms for restraining the projectile from moving in the chamber 34 may be provided. Detents, springs, constrictions, and the like, may all be suitable mechanisms for retaining a projectile 32 within the chamber 34 prior to launch or firing.

A variety of seals 36 contain propellant gases. Seals 36 may be static, positioned between fixed pieces having no relative motion, or may be dynamic, positioned to seal movable members against passage of fluids along the movable surfaces thereof.

In certain embodiments, a bolt 40 may include an actuator 38 or valve 38 and a head 41. The actuator 38 provides valving and control dynamically during operation of the gun 10. Specifically, the actuator 38 controls the inlet, containment, and discharge of propellant within the cavity 31, or propellant chamber 31, in a proper sequence for loading and firing the gun 10.

The head 41 of the bolt 42 provides impetus to a projectile 32, while also blocking the feed of additional projectiles 32 from the magazine 16, until a proper event occurs. Likewise, until properly released, the bolt 40, and particularly the outermost portion associated with the head 41, operates to activate the trigger system 18. Accordingly, in a true semi-automatic fashion, the bolt 40 permits feeding of a projectile 32 only with each cycle of the trigger mechanism 18 and each corresponding cycle of the action 14.

A return spring 42 operates against a lip 43 at the back end of the bolt head 41 to return the bolt 40 "into battery." That is, during a firing sequence, the bolt 40 moves forward, launching a projectile 32, and expelling propellant from the propellant chamber 31 into the projectile chamber 34, accelerating the projectile 32 down the barrel 20. Completing a firing cycle, if firing is to be semiautomatic, the bolt 40 must return to a ready-to-fire position in order to be released by the trigger assembly 18 again.

From return to a ready-to-fire position, the head 41 of the bolt 40 receives significant energy from the return spring 42. A resilient and energy-absorbent bumper 44 supported by the frame 12 of the gun 10 can absorb impact loads associated with the bolt 40 coming to rest in a ready-to-fire position.

Figure 3:
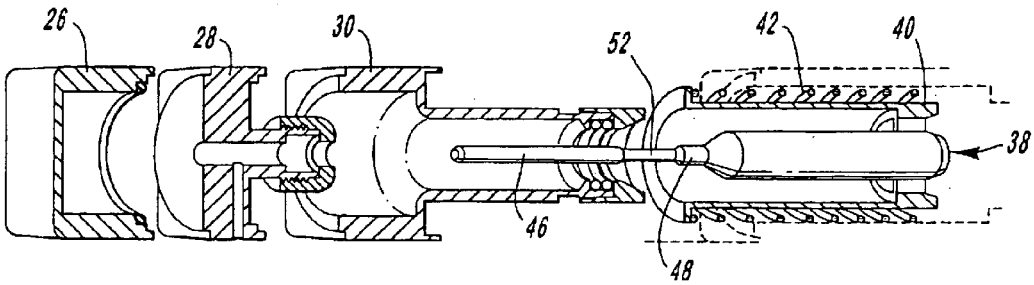
FIG. 3 is a top, cutaway, perspective view of a selected portion of the action of the apparatus of FIG. 2.

Referring to FIG. 3, the actuator 38 may be thought of as comprising multiple portions. For example, a rear shaft 46 or tail shaft 46 may operate as a spool valve 46 for controlling the inlet of propellant 58 into the propellant chamber 31. A front shaft 48 or head shaft 48 may similarly operate as a spool valve during advance of the bolt 40 forward. Thus, proper shaping of the tail shaft 46 and head shaft 48 will provide dynamic tailoring of the opening and closing of access to the propellant 58 for passage through the chamber 31 and chamber 34.

In addition to the head shaft 48, which may be optional in certain embodiments, and refers generally to the portion of the actuator 38 that is near the head 41 of the bolt 40, a nose shaft 50 may selectively move to form a seal for releasing propellant 58 from the chamber 31 into the chamber 34. The nose shaft 50 has a shape, length, and associated surfaces required to promote capture of propellant 58 within the propellant chamber 31 or propellant cavity 31. Accordingly, as the bolt 40 moves forward, both the head 41 and actuator 38 advance through the ammunition chamber 34, initiating movement of a projectile 32, under force of the pressure of the propellant 58 in the propellant chamber 31. However, as the nose shaft 50 necks down to the head shaft 48 or front shaft 48, the seal is broken, releasing the pressure acting on the bolt 40 as the propellant 58 is vented from the propellant chamber 31 into the ammunition chamber 34.

The middle shaft 52 represents a portion of the actuator 38 that may be reduced further in diameter to provide clearance for passing propellant past the middle shaft 52 into the propellant chamber 31. Thus, whereas the tail shaft 46 will seal off passage of propellant from the magazine 16 into the propellant chamber 31, positioning the middle shaft 52 in a seal region permits filling the propellant chamber 31 due to the additional clearance provided by a necked-down diameter of the middle shaft 52 (mid-shaft region 52).

Figure 4:
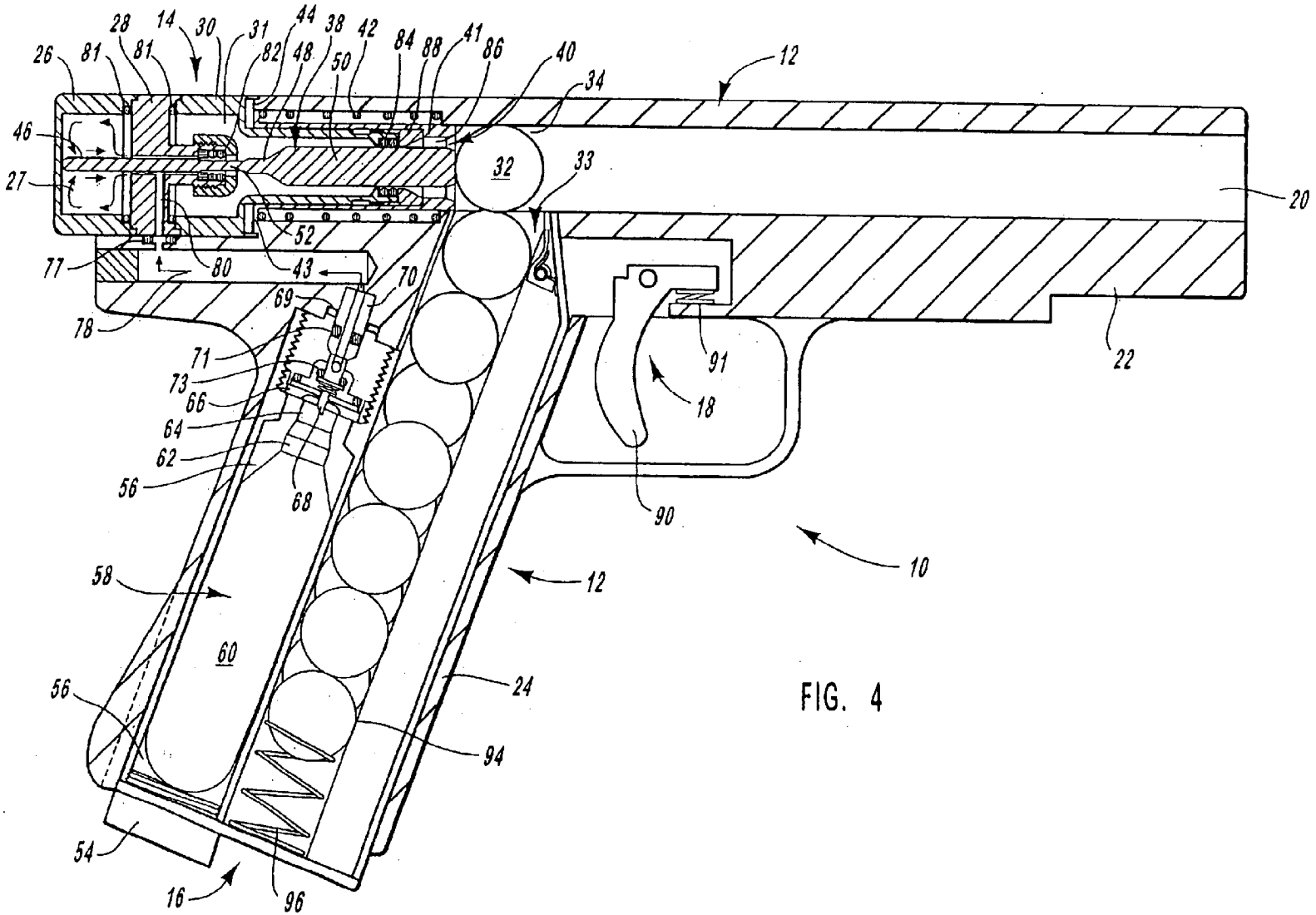
FIG. 4 is a side, elevation, cross-sectional view of the apparatus of FIG. 2.
Figure 5:
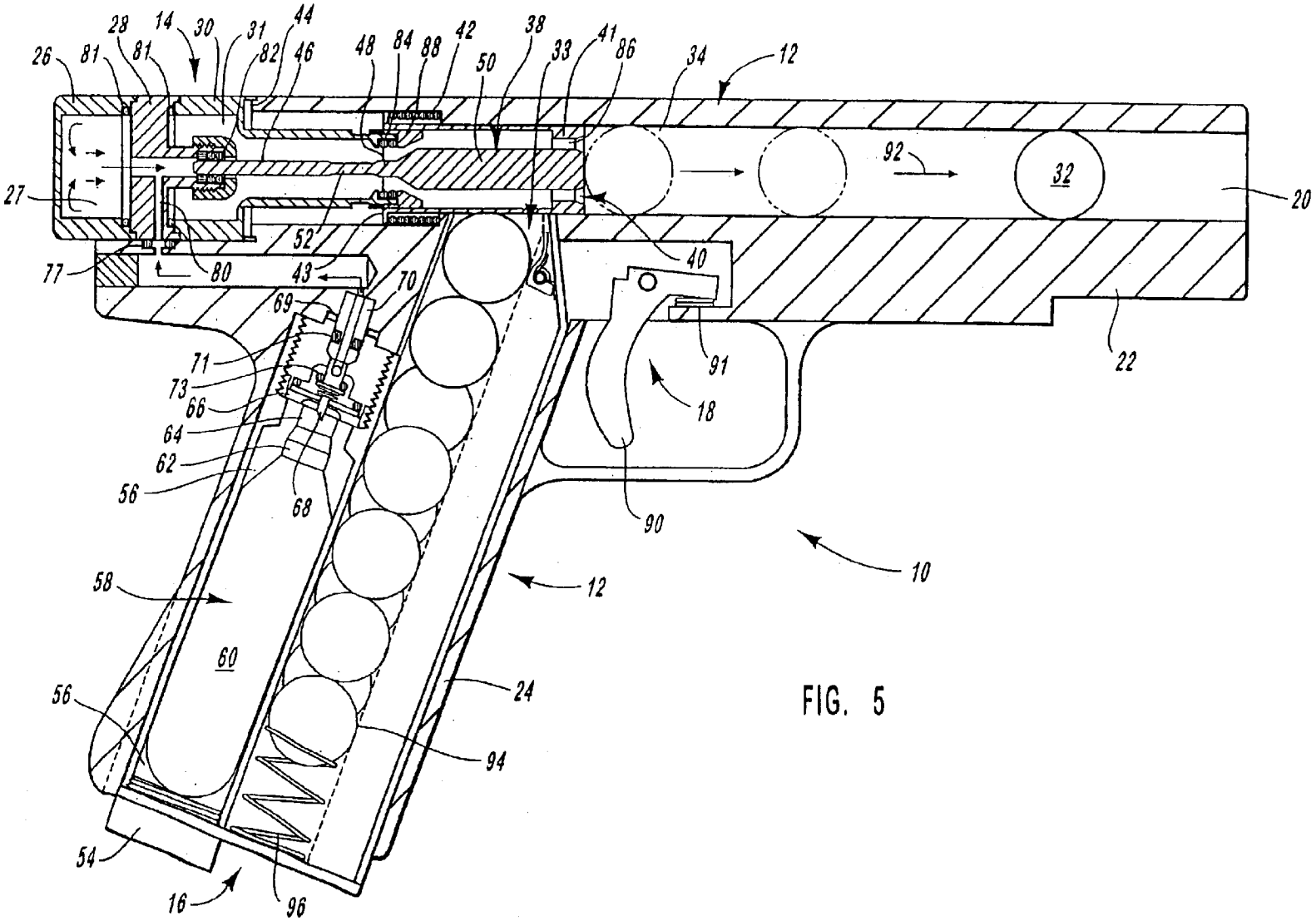
FIG. 5 is a side, elevation, cross-sectional view of the apparatus of FIG. 4 in a fired position.

Referring to FIGS. 4–6, while continuing to refer generally to FIGS. 1–17, a cap 54 may close a receiver 56 for holding propellant 58 in a cartridge 60 or container 60. The cartridge 60 may reduce in size near a neck 62. A cap 64 may seal the neck 62, containing the propellant 58 as a compressed gas, saturated liquid, or the like. In certain embodiments, the end cap 54 may seal the receiver chamber 56. In other embodiments, a seal 66 or washer 66 may fit snugly against the cap 64 in order to seal the opening in the cap 64 formed by a penetrator 68. In general, a penetrator 68 may be a hollow, syringe-needle-like member 68 adapted for puncturing the metal cap 64 to access the contained propellant 58. Through the hollow penetrator 68, the propellant 58 may release for delivery into the action 14 of the gun 10.

Another seal 69 may further seal the magazine 16 against the frame 12 of the gun 10. In certain embodiments, an activator 70 may extend into the gun 10 for providing mechanical and fluid communication therewith. A seal 71, in combination with a seal 69 may secure leak-free fluid communication between the gun and the cartridge 60 through the activator 70. The activator 70 may be designed to be a part of the gun 10 or a part of the magazine 16. In either event, the activator 70 is moved, by the insertion of the magazine 16 into the gun 10, against a poppet 72 that is urged into a closed position by a spring 74. When the magazine 16 is removed from gun, the spring 74 forces the poppet 72 and accompanying seal 76 into a closed position. The poppet 72 can only vent gases from the cartridge 60 when the poppet 72 and associated seal 73 are in an open position as illustrated in FIG. 3.

Additional seals 76 may operate to secure the path of the propellant 58 from the cartridge 60 into the activator 70 and into a passage 78 in the gun 10. In certain embodiments, the passage 78 may be formed in the frame 12 of the gun, which may, in turn, be secured by a seal 77. The action 14 may contain an inlet 80 for receiving propellant 58 from the passage 78 past the seal 77. Other seals 81 may be distributed among various components of the gun 10 in order to seal separable pieces.

Referring to FIGS. 4–5, while continuing to refer generally to FIGS. 1–17, a tail seal 82 may include one or more single "O " rings 82. The tail seals 82 are configured to sealingly contact the tail shaft 46. When the tail shaft 46 is aligned to contact the tail seals 82, propellant 58 is sealed against intrusion into the propellant cavity 31. If the middle shaft 52 is aligned with the tail seals 82, the resulting clearance therebetween provides passage of propellant 58 from the inlet 80 to the propellant chamber 31.

In certain embodiments, the cavity 27 of the enclosure 26 may be in fluid communication with the inlet 80 and the propellant chamber 31. Thus, when the inlet 80 provides propellant 58 from the cartridge 60, that propellant 58 may pass into the cavity 27. If the tail shaft 46 and tail seals 82 are positioned in sealing relation, then no propellant 58 passes into the propellant chamber 31. On the other hand, when the middle shaft 52 is aligned with the tail seal 82, both the cavity 27 and the propellant chamber 31 are in fluid communication with the inlet 80, receiving propellant. Thus, the cavity 27 tends to form a buffer and a reservoir 27 holding a pressurized amount of propellant 58, and providing the pressure thereof against the tail shaft 46, urging the bolt 40 forward.

Nose seals 84 associated with the nose shaft 50 provide a similar sealing arrangement. In certain embodiments, the nose shaft 50 is designed to be of a length such that the bolt 40 may advance down the barrel 20 a selected distance before the head shaft 48, passes the nose seal 84. With the bolt 40 in a retracted or ready-to-fire position, the nose seal 84 and nose shaft 50 together form a seal on the propellant chamber 31. Upon release of the bolt, pressure within the cavity 27 urges the actuator 38 forward by acting on the tail shaft 46. Similarly, pressure from the propellant 58 in the propellant chamber 31 acts on the cross-sectional area of the nose shaft 50 to urge the bolt 40 forward. Once the bolt 40 begins moving forward, such that the tail shaft 46 has aligned with the tail seal 82, the propellant chamber 31 is sealed away from the inlet 80 and the cavity 27. Accordingly, the charge of propellant 58 contained at that point within the propellant chamber 31 is the entire charge to be used to accelerate the bolt 40 and the projectile 32.

As the bolt 40 advances across the opening 33 and into the chamber 34 toward the barrel 20, the nose shaft 50 eventually passes the nose seal 84. As the reduced diameter of the head shaft 48 or the middle shaft 52 aligns with the nose seal 84, the propellant 58 within the propellant chamber 31 is released through the opening 86 or clearance 86 between the nose shaft 50 and the attached bolt head 41.

Securement of the bolt head 41 to the nose shaft 50 may be accomplished in a variety of ways. In one embodiment, the head shaft 50 may be threaded into a fitting in the bolt head 41, and the bolt head 41 may be provided with large vents 86 connected by thin webs to the nose shaft 50. Thus, the openings 86 may be substantial, providing relatively minor resistance to flow of the propellant 58 from the propellant chamber 31 to the projectile chamber 34.

Once the propellant 58 is free to vent from the propellant chamber 31 into the projectile chamber 34 and the barrel 20, further acceleration of the projectile 32 is due to the expansion of the propellant 58. Likewise, further urging of the bolt 40 forward by the propellant 58 ceases.

As the bolt 40 progresses forward down the chamber 34 and barrel 20, the return spring 42 is compressed against a lip 43 of the head 41 of the bolt 40. Thus, the energy provided by the propellant 58 in the propellant chamber 31 is resisted by the return spring 42 at an ever increasing value as the bolt 40 moves forward. Thus, once the pressurization of the propellant 58 ceases, the return spring 42 urges the lip 43 of the head 41 to reverse direction, returning toward the rear of the gun 10 and action 14.

Referring to FIGS. 4–5, while continuing to refer generally to FIGS. 1–17, the chamber 30 may provide a diffuser 88 for optimizing the flow of propellant from the propellant chamber 31 (cavity), through the bolt 40, and into the chamber 34 and barrel 20. The diffuser may be important since extremely high mach numbers arise from the differential pressures between the propellant chamber 31 and the barrel 20 upon initial opening of the nose seal 84.

A trigger assembly 18 may include a trigger 90 having a return spring 91 for positioning the trigger 90 in a ready-to-fire position. Upon actuation of the trigger 90 by a user, the trigger assembly 18 releases the lip 43 of the head 41 of the bolt 40, and propellant pressure acting on the tail shaft 46 and nose shaft 50 propels the bolt 40 forward. Movement of the bolt 40 down the barrel 20, begins acceleration of the projectile 32, through the aperture 33 and blocks any further entry of projectiles 32 from the magazine 16 into the chamber 34.

Shortly after movement begins by the bolt (including the actuator 38 and head 41 of the bolt 40), at a position and associated time defined by the position of the middle shaft 52, the tail shaft 46 seals off the propellant chamber 31 from the inlet 80 and the buffering cavity 27. The bolt 40 then continues forward down the barrel 20 until the nose shaft 50 passes the nose seal 84. A clearance between the nose seal 84 and the front shaft 48 or middle shaft 52 provides sufficient freedom for the propellant 58 to exit the propellant chamber 31 and cease urging the bolt 40 forward. The propellant 58 continues down the barrel 20 behind the projectile 32, expanding as it goes.

Having vented the propellant 58 to the barrel 20, and ultimately to atmospheric pressure, the bolt 40 is urged rearwardly by the return spring 42. The return spring 42 acts on the lip 43 returning the bolt 42 against a bumper 44. At this position, the nose seal 84 has closed the propellant cavity 31, and the middle shaft 52, upon alignment with the tail seal 82, communicates propellant 58 from the cavity 27 and inlet 80 into the propellant chamber 31 for refilling.

Figure 6A:
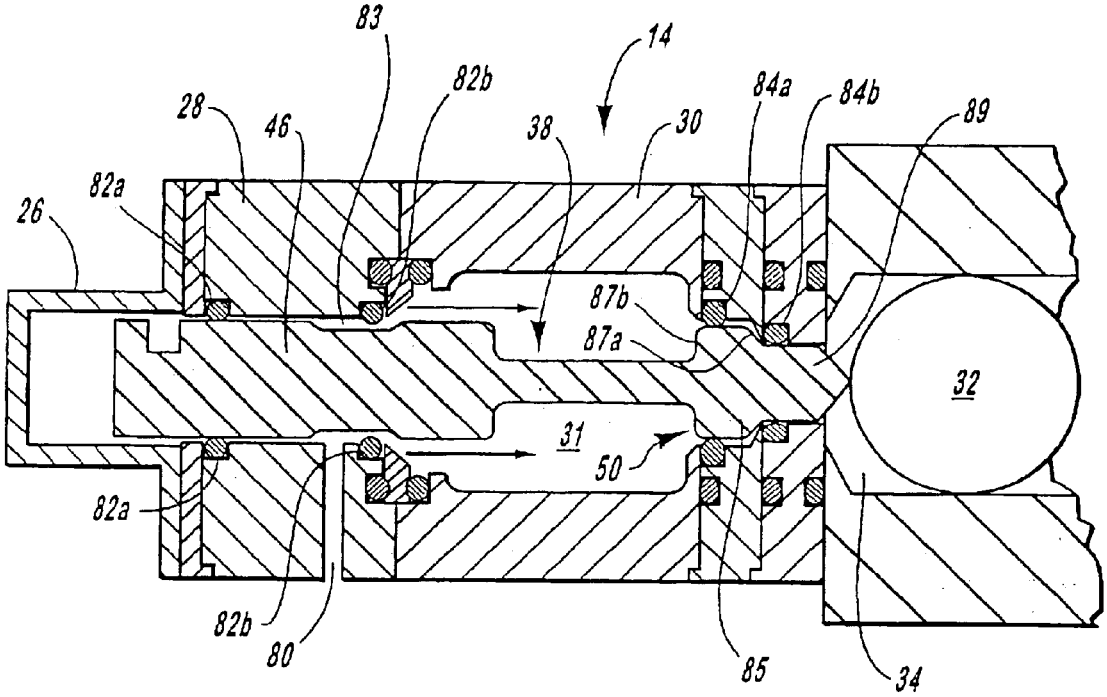
FIGS. 6A–6B are top, plan, cross-sectional views of an alternative embodiment of an apparatus in accordance with the invention.
Figure 6B:
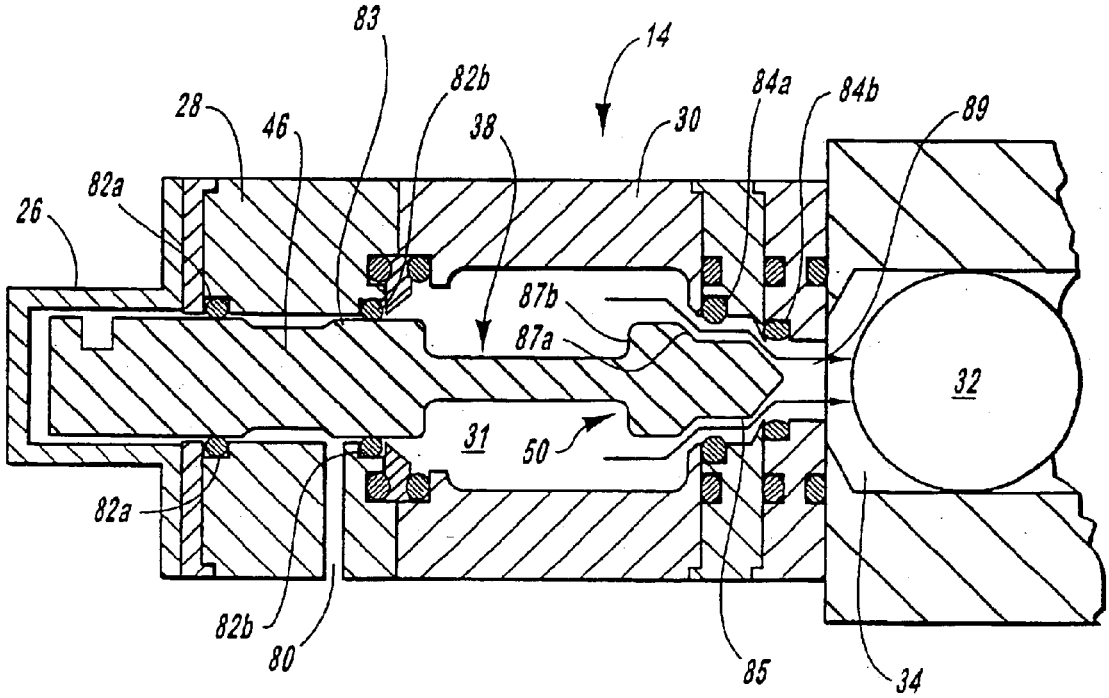
Figure 7:
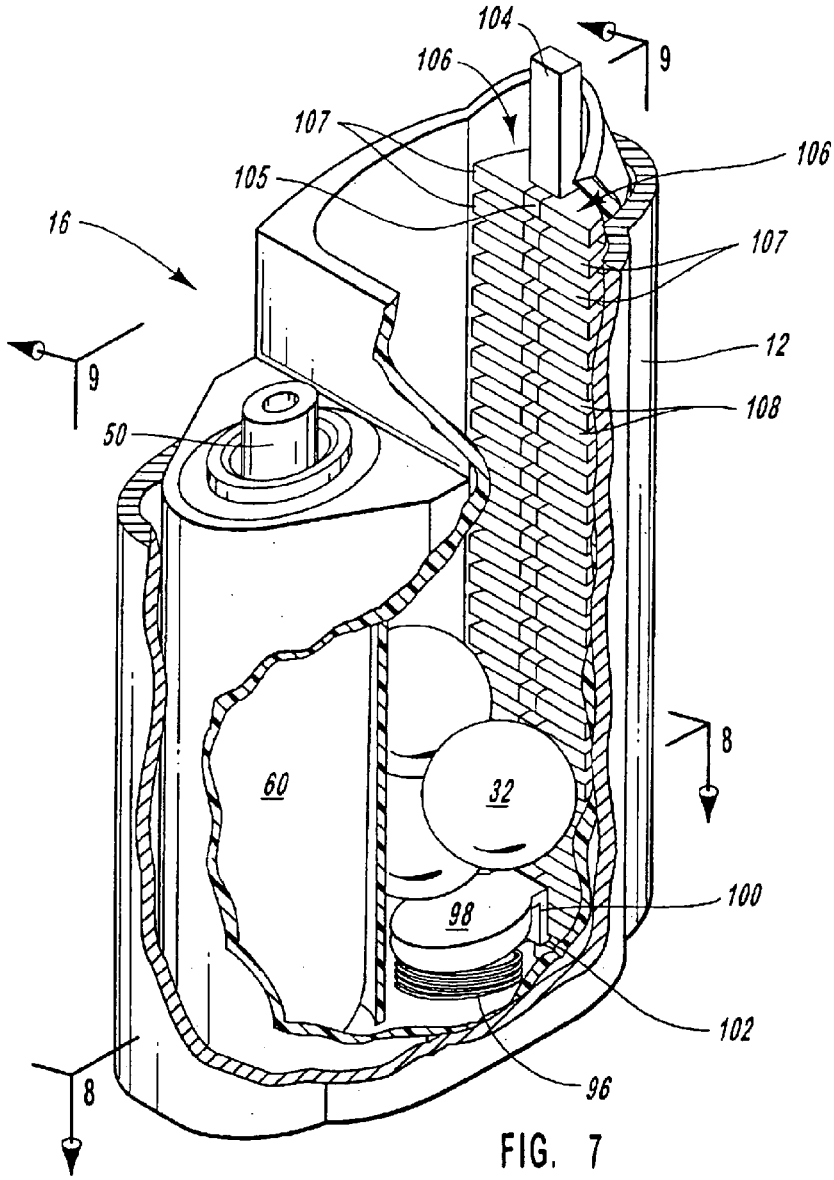
FIG. 7 is a perspective, partially cutaway view of one embodiment of a magazine in accordance with the invention.
Figure 8:
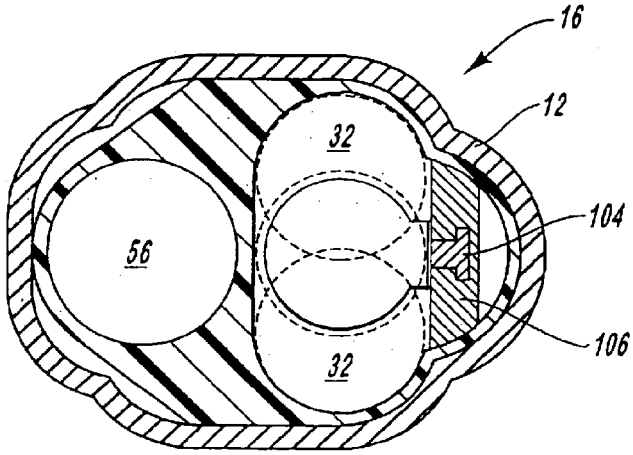
FIG. 8 is a top, plan, cross-sectional view of the apparatus of FIG. 7.
Figure 9:
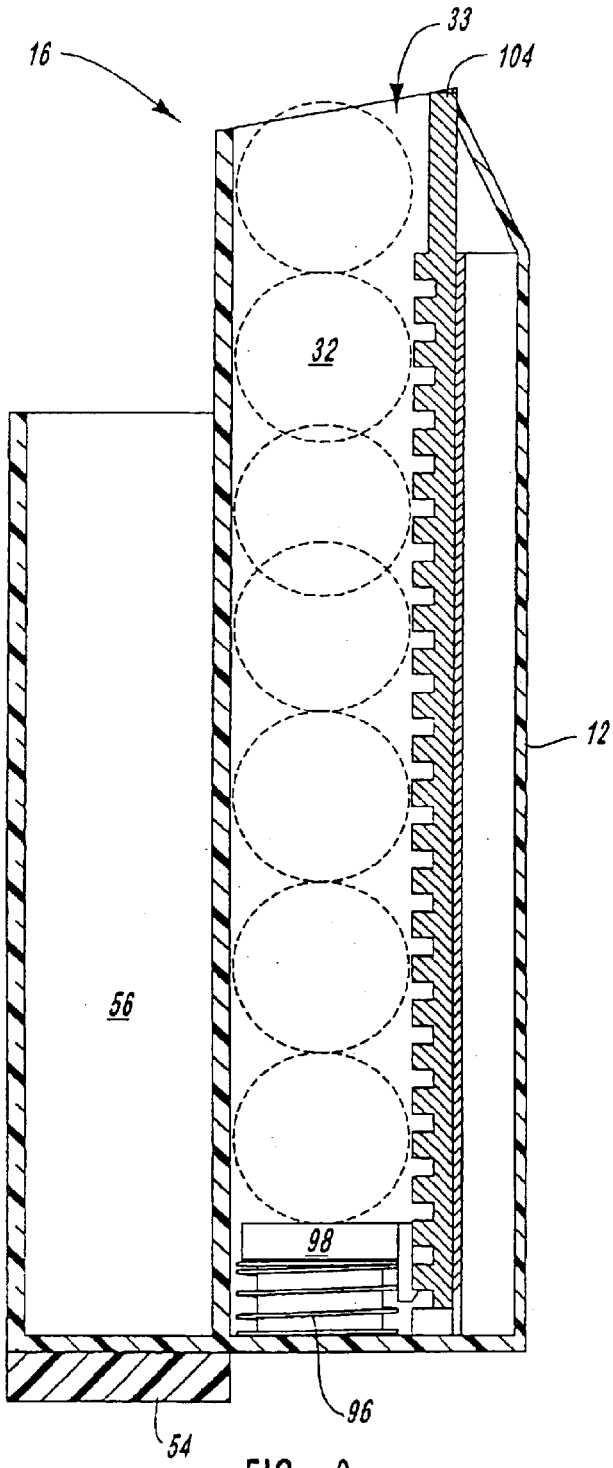
FIG. 9 is a side, elevation, cross-sectional view of the apparatus of FIG. 7.
Figure 10A:
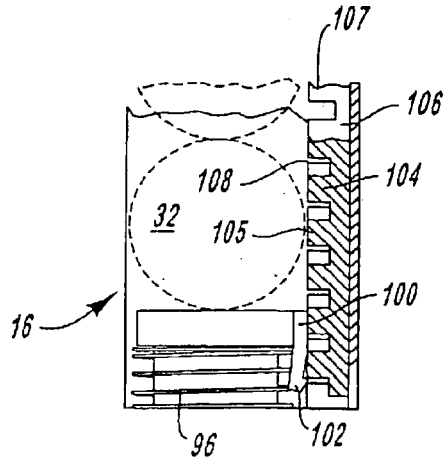
FIGS. 10A–10C are partial, side, elevation, cross-sectional views of the apparatus of FIGS. 7–9 illustrating, respectively, a misalignment-detention position, an initial released position, and a subsequent released position.
Figure 10B:
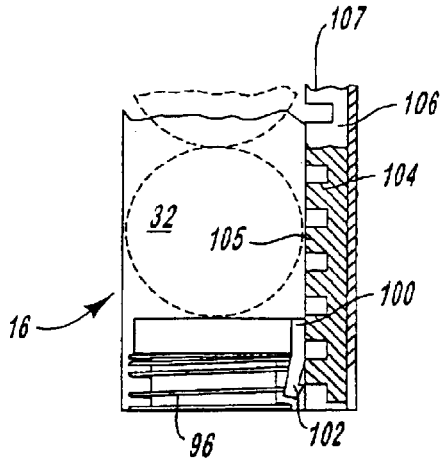
Figure 10C:
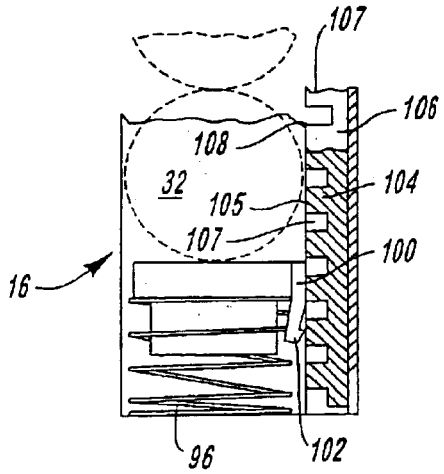

Referring to FIGS. 6A–6B, while continuing to refer generally to FIGS. 1–17, an actuator 38 may be designed to operate as the sole element of a bolt 40. In the embodiment of FIG. 6 (e.g. 6A–6B), double nose seals 84*a*, 84*b* and double tail seals 82*a*, 82*b* seal the propellant chamber 31. In a ready-to-fire position illustrated in FIG. 6A, the actuator 38 has positioned a clearance 83 or necked-down region 83 over the front tail seal 82*b*. Thus, the inlet 80 has fluid communication for passing propellant into the propellant chamber 31. Meanwhile, a shoulder 85 of the nose shaft 50 seals against the rear nose seal 84*a*. Similarly, a nose 89 seals against a front nose seal 84*b*. Upon release of the actuator 38, the actuator 38 moves rearwardly toward the tail seals 82*a*, 82*b*. The clearance 83 moves past the front tail seal 82*b*, putting the maximum diameter of the tail shaft 46 against the front tail seal 82*b*. This effectively seals the inlet 80 away from the propellant chamber 31. Meanwhile, the specific distances involved are calculated to provide coordinated sealing of the inlet 80 before breaking the sealing effect of the nose seal 84*b*.

Referring to FIG. 6B, as the actuator 38 moves rearwardly, the front face 87*a* is first exposed to the pressure of the propellant chamber 31 in opposition to the force previously applied only to the rear face 87*b* of the shoulder 85. Thus, once the shorter shoulder 85 passes the rear nose seal 84*a*, propellant moves in front of the front face 87*a*, more rapidly urging the retreat (retraction, rearward direction) of the actuator 38.

Eventually, the nose 89 of the nose shaft 50 of the actuator 38 clears the front nose seal 84*b*, releasing the propellant 58 in the propellant chamber 31 into the projectile chamber 34. The pressure of the propellant 58 released into the chamber 34 accelerates a projectile 32 down the barrel. A return mechanism moves the actuator forward to the position illustrated in FIG. 6A.

The nose 89 first seals with the nose seal 84*b*, then the shoulder 85 seals with the rear nose seal 84*a*. Thereafter, the tail shaft 46 exposes the front tail seal 82*b* to the clearance 83, again filling the propellant chamber 31 through the inlet 80. The tail seal 82*a* maintains a sealing relationship with the tail shaft 46 at all times in certain embodiments.

Referring to FIGS. 7–10C, while continuing to refer generally to FIGS. 1–17, alternative designs for a magazine 16 provide various advantages. For example, in certain embodiments, the projectiles 32 may be stored in a stacked arrangement. A pad 98 may conform to the shape of the projectiles 32 in order to aid advancing the column of projectiles 32 upward along the magazine. In certain embodiments, the pad 98 is advanced by a spring 96 or feed spring 96 urging the pad 98 upward toward the projectile chamber 34.

However, a retainer 100 equipped with a detent 102 or tooth 102 provides a restriction on motion of the pad 98 above the spring 96. In certain embodiments, the magazine 16 may include a rail 104 having teeth 105 or projections 105. Similarly, a corresponding rail 106 may have teeth 107 of a corresponding pitch and size. Between the teeth 105 and between the teeth 107, gaps 108 remain. The teeth 105, 107 are sized to at least fill the gaps 108. That is, when the rail 104 is offset with respect to the rail 106, then the teeth 105 may be misaligned with the teeth 107, or, more appropriately, asynchronously aligned with the teeth 107. Thus, the teeth 105 are aligned with gaps 108 in the rail 106. Similarly, the teeth 107 are aligned with the gaps 108 between the teeth 105.

When the teeth 105, 107 are aligned, or nearly so, the gaps 108 are sufficient that the retainer 100 urges the detent 102 into the gaps 108. This condition may exist when the magazine 16 is removed from the gun 10. Thus, the spring 96 is restrained by the retainer 100 and pad 98, from advancing. Thus, the projectiles 32 remain in the magazine and are not urged to exit.

By contrast, when the teeth 105, 107 are asynchronously aligned, the detent 102 encounters a substantially continuous wall represented alternately but continuously by the teeth 105, 107. Thus, the detent 102 cannot penetrate any gaps 108, the gaps 108 being blocked from access by intervening teeth 107, 105, respectively.

The rail 104 may extend a distance sufficient to engage a portion of the gun 10, such as a portion of the gun frame 12, in order to provide the misalignment of the teeth 105 from the teeth 107. In certain embodiments, the rail 104 may be thought of as a slide 104, urged into alignment with the rail 106. Inserting the magazine 16 into the gun 12 actuates the rail 104 misaligning (asynchronously aligning) the teeth 105 with respect to the teeth 107.

Figure 11A:
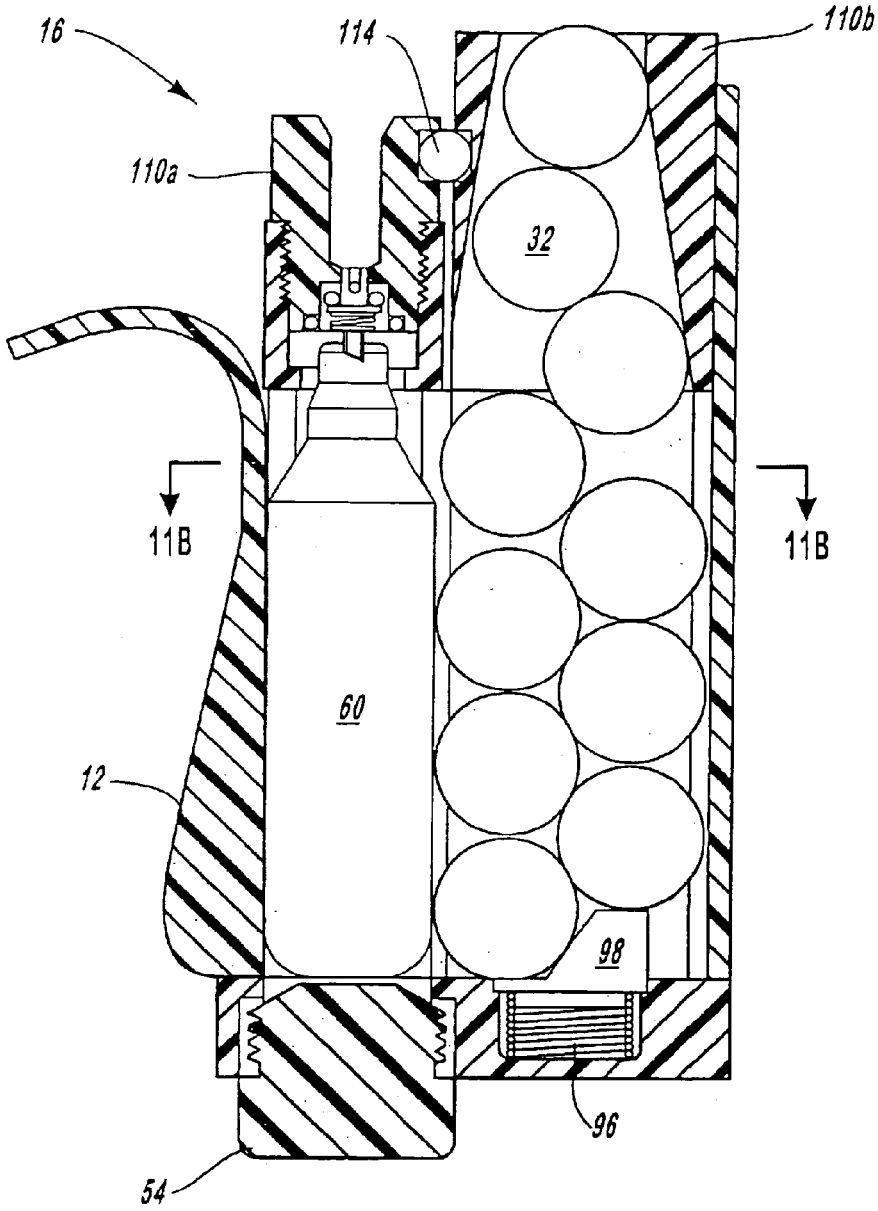
FIG. 11A is a side, elevation, cross-sectional view of an alternative embodiment of a magazine in accordance with the invention.
Figure 11B:
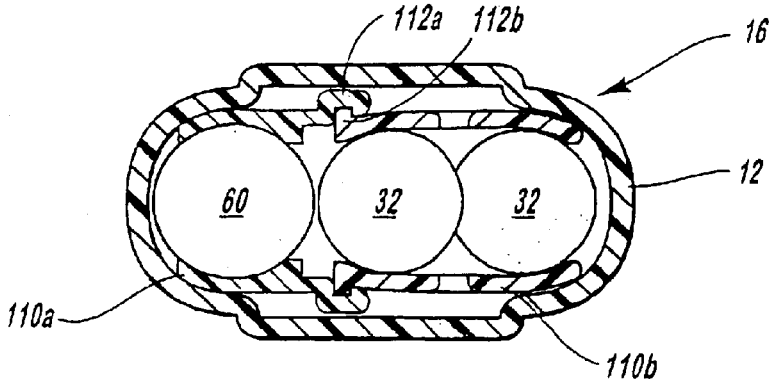
FIG. 11B is a top, plan, cross-sectional view of the apparatus of FIG. 11*a;*
Figure 12A:
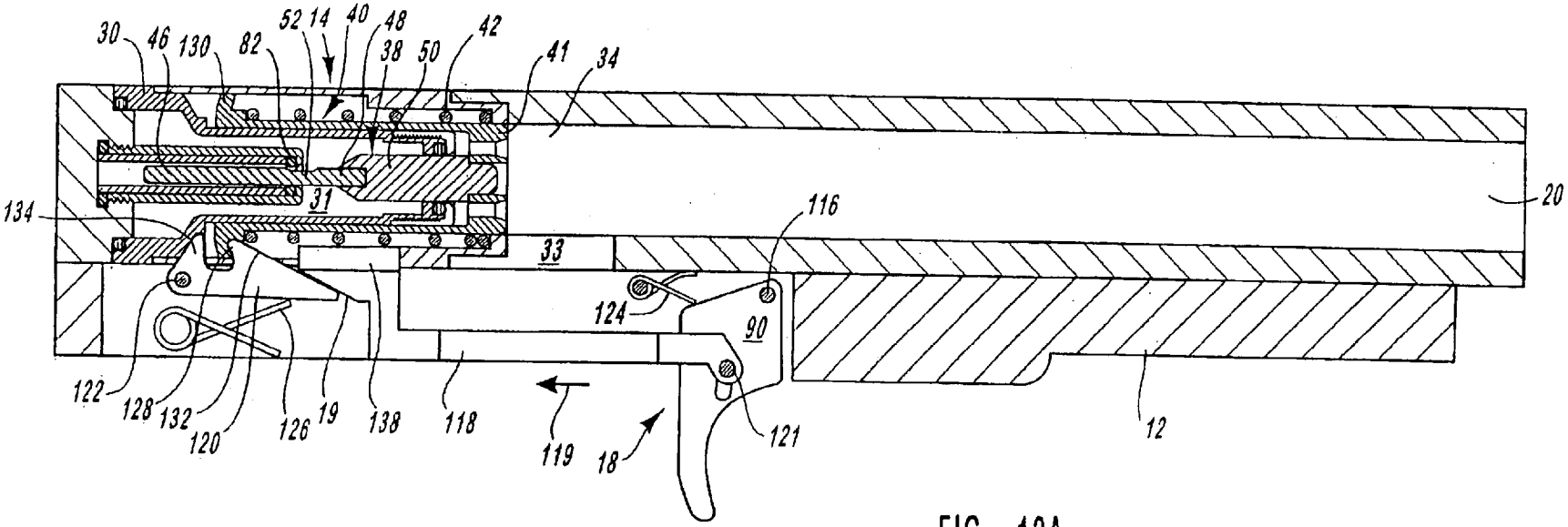
FIG. 12A is a side, elevation, cross-sectional view of an alternative embodiment of an action and trigger mechanism in an apparatus in accordance with the invention.
Figure 12B:
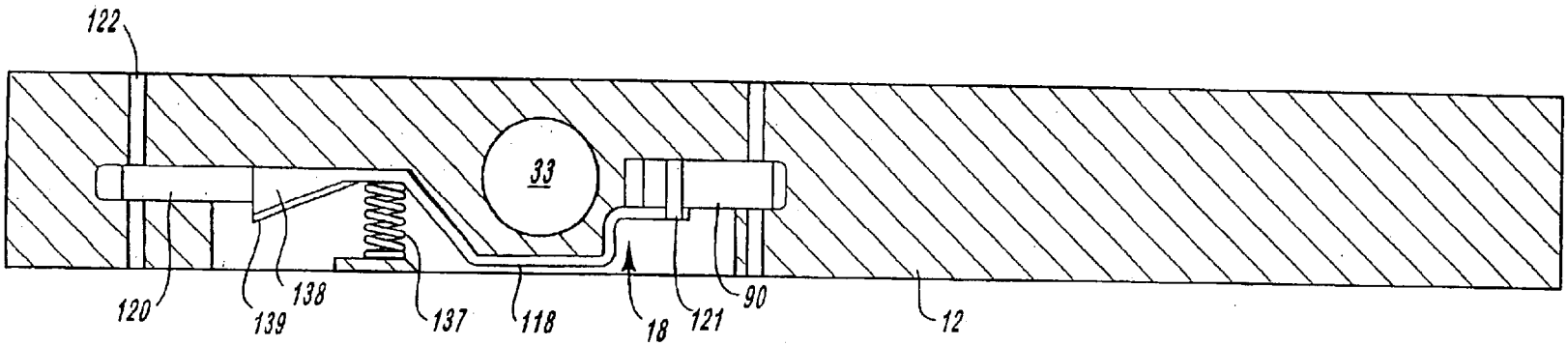
FIG. 12B is a top, plan, cross-sectional view of the apparatus of FIG. 12A.

Referring to FIGS. 11A–11B, an alternative embodiment for a magazine 16 may be formed halves 110*a*, 110*b*. The halves 110*a*, 110*b* may fit together for insertion into a portion of the frame 12 of the gun 10. In certain embodiments, the magazine 16 may be formed of halves 110*a*, 110*b* having respective, cooperating, mutually engaging slides 112*a*, 112*b*.

In certain embodiments, a magazine 16 may hold approximately 10 rounds of projectiles 32. By contrast, a common size of cartridge 60 may contain sufficient propellant 58 to fire twenty-five to thirty projectiles 32. Thus, it is advantageous to a user if a portion 110*b* of a magazine 16 containing projectiles 32 can be extracted and reloaded independently from the portion 110*a* containing the propellant cartridge 60.

A blowdown process is a thermodynamic event in which a pressurized quantity of fluid is allowed to expand rapidly. During a blowdown process, massive temperature drops may occur. Even in comparatively small quantities of propellant 58, blowdown of the propellant within the cavity 27 may be sufficient to chill elements of the action 14.

Chilling, in and of itself, can affect the clearances and tolerances of components of the action 14. Moreover, the presence of any water vapor within the action 14, combined with a rapid decrease in temperature due to a blowdown process, can result in small quantities of frozen water at inconvenient locations in the action 14. Thus, minimizing the number of blowdowns experienced by the action 14 is one way to improve the reliability of operation of the action 14.

Since expansion of propellant 58 from the propellant chamber 31 is also a blowdown process, continued chilling of the action 14 is already occurring in the normal course of operation of the gun 10. Accordingly, it is beneficial to minimize any additional cooling that may occur. Thus, the ability to leave the cartridge 60 and its portion 110*a* of the magazine 16 in place may be very beneficial.

In the embodiment of FIGS. 11A–11B, a key 114 may operate by any suitable mechanism to release the projectile portion 110*b* of the magazine 16 from engagement with the propellant portion 110*a*. The key 114 may be a knob, button, slide, clip, or other mechanism suitable for selectively engaging and disengaging the projectile portion 110*b* from the propellant portion 110*a*. The key 114 may be exposed to the outside surface of the gun such that a user may have ready access thereto for releasing the projectile magazine 110*b*.

Referring to FIGS. 12A–13B, specifically, while continuing to refer generally to FIGS. 1–17, a trigger 90 may pivot about a pin 116 in response to a user urging the trigger 90 against a linkage 118 in a rearward direction 119. The linkage 118 may be a slide 118 in certain embodiments.

One principal function of a linkage 118 is to transfer a rearward 119 motion of the trigger 90 to release a sear 120 or latch 120 securing a bolt 40 in a ready-to-fire position. A pin 121 penetrating the trigger 90 may pivotably secure a linkage 118 to the trigger 90. Actuation of the trigger 90 moves the linkage 118 in a rearward direction 119, urging rotation of the sear 120 about a pin 122 therethrough. The pin 122 serves as a pivot 122 for one embodiment of a sear 120 as illustrated in FIGS. 12A–13B.

A return spring 124 may urge the trigger 90 into a ready-to-fire position. Similarly, a return spring 126 may urge the sear 120 into a ready-to-fire position. In one embodiment, a lip 128 on the sear 120 engages a lip 130 of the bolt 40, and particularly of the bolt head 41. The sear 120 includes a ramp 132 or ramped portion 132 for engaging a surface 19 of the linkage 118. The surface 19 acts to urge the sear 120 into rotation about the pin 122, in response to rearward 119 motion of the trigger 90 and linkage 118. As the sear 120 is rotating clockwise, the lip 128 releases the lip 130 (e.g. 43), freeing the bolt 40 to advance forward into the chamber 34, covering the feed aperture 33, and launching a projectile 32 down the barrel 20.

Figure 13A:
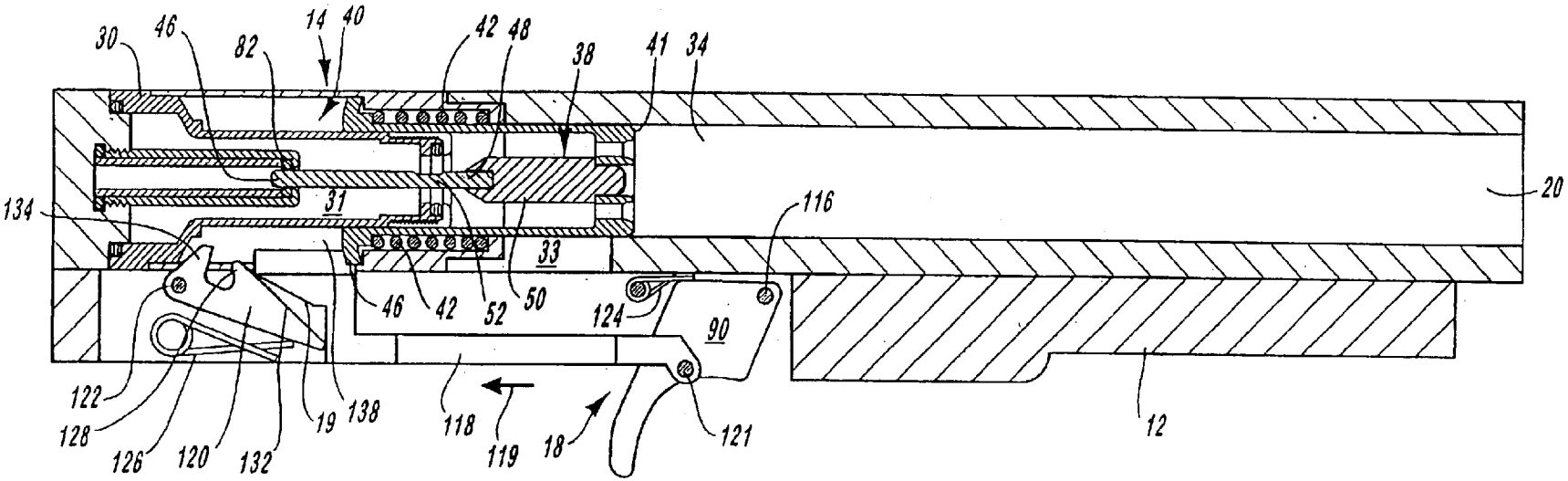
FIG. 13A is a side, elevation, cross-sectional view of an alternative embodiment of an action and trigger mechanism in an apparatus in accordance with the invention, in a fired position.
Figure 13B:
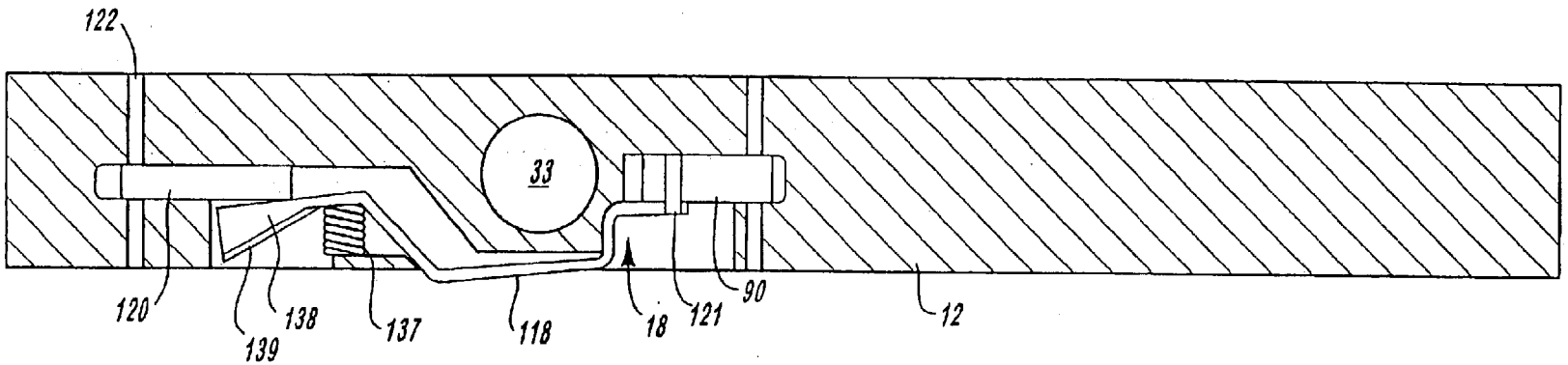
FIG. 13B is a top, plan, cross-section view of the apparatus of FIG. 13A, in a fired position.

Upon completion of the firing sequence, the return spring 42 is compressed as illustrated in FIG. 13A. Meanwhile, the catch 130 or lip 130, in moving forward during the operation of firing, strikes a wall 139 associated with a wedge 138 in the linkage 118, driving the wedge 138 laterally away from the sear 120. The wedge 138 remains thus misaligned, against the urging of a spring 137, until the return of the bolt 40 to the ready-to-fire position.

Following expulsion of propellant 58 from the propellant chamber 31, past the nose seal 84, through the head 41 of the bolt 40, and into the bore 20 of the gun 10, the compressed return spring 42 urges the head 41 and bolt 40, including the actuator 38 in a rearward direction.

Continuing to refer specifically to FIGS. 12A–13B, while continuing to refer generally to FIGS. 1–17, the trigger 90 and linkage 118 return forward under the urging of the return spring 124. Nevertheless, the lip 130 of the head 41 of the bolt 40 strikes a slope 132 or ramp 132 of the sear 120 dropping the lip 128 or rotating the lip 128 clockwise away from the lip 130. After the lip 130 has passed the lip 128 of the sear 120, the spring 126 will urge the sear 120 back into a ready-to-fire position. As an added assurance, the energy of the bolt 40 is applied to strike the lip 130 against a pawl 134 on the back end of the sear 120 rotating the sear counterclockwise and into engagement of the lip 128 with the lip 130. At this point, the linkage 118 has returned forward, clearing the way for the wedge 138 and associated wall 139 to move toward the center of the action 14, at the urging of the spring 137. Thus, the wedge 138 may return into alignment for activating the sear 120 upon the next actuation of the trigger 90.

Figure 14A:
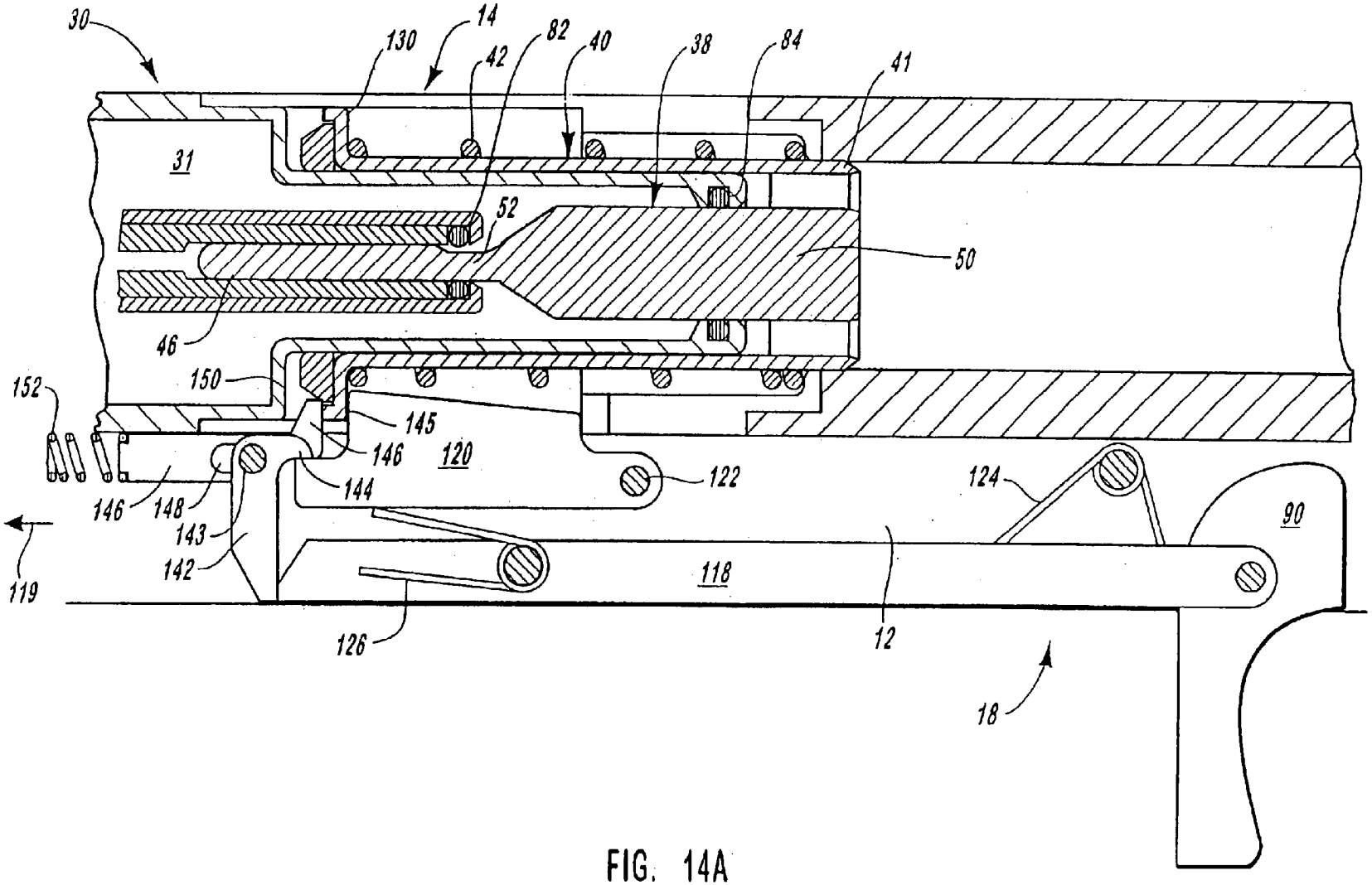
FIGS. 14A–14E are side, elevation, cutaway, cross-sectional views of an alternative embodiment of an action and corresponding trigger mechanism in accordance with the invention, positioned in a ready-to-fired position, bolt-returned position, sear-returned position, and pawl-returned position, respectively.

Referring to FIGS. 14A–14A, while continuing to refer generally to FIGS. 1–17, an alternative embodiment of a trigger mechanism 18 may also rely on a trigger 90 connected to a linkage 118 for activating a sear 120 restraining a bolt 40. Initially, as illustrated in FIG. 14A, all components are positioned in a ready-to-fire position. From this position, the trigger 90 may be urged in a rearward direction 119, moving a slide 118 or linkage 118 backward, likewise. The trigger 90 moves against the resistance of return spring 124 urging the trigger forward or counterclockwise.

A sear rotator 142 pivots about a pin 143. A pawl 144 or tip 144 on the sear rotator 142 engages a portion of the sear 120. Upon a rearward 119 motion of the linkage 118, the sear rotator 142 is rotated counterclockwise, drawing the sear 120 down in a clockwise motion about the pin 122. Upon sufficient motion, dictated by the interference between the sear 120 and the pawl 144, the sear barb 145 or pawl 145 disengages from the lip 130 of the bolt 40.

Figure 14B:
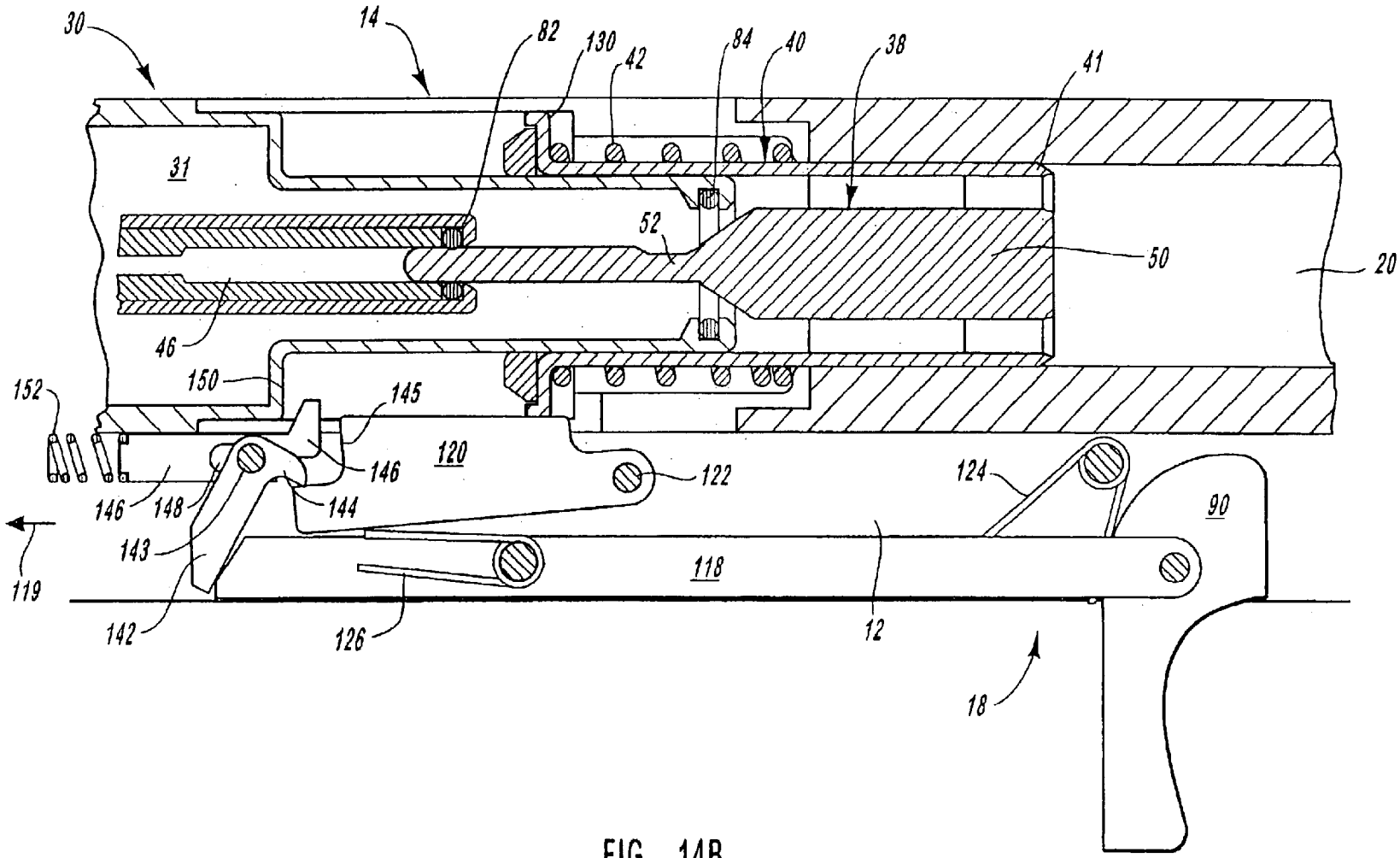

As discussed above, since the propellant chamber 31 is pressurized, the tail shaft 46 and nose shaft 50 urge the bolt 40 forward. The bolt 40 moves forward accordingly, as illustrated in FIG. 14B. The projectile 32 and bolt 40 are launched forward, with the propellant 58 escaping between the middle shaft 52 and nose seal 84 until the environment and the propellant chamber 31 are substantially in pressure equilibrium. Thereupon, the return spring 42 urges the lip 130 and bolt 40 in a rearward direction 119.

As the bolt 49 moves rearward 119, the lip 130 makes contact with a sear release 146. The sear release 146 slides rearward 119 under the load applied by the firing bolt. The sear release 146 is free to move a limited distance along a slot 148. As the sear release 146 moves along the slot 148, contact is made with a rotating pin 143 fixed in the sear rotator 142. The sear rotator pin 143 is solidly attached to the sear rotator 142, operating such that the sear release 146 pushes the pin 143 in a rearward direction 119, moving the sear rotator backwards 119 therewith.

As the firing bolt 40 continues to move the sear release 146 backwards 119, with the sear rotator 142, the sear release 146 will contact a portion of the frame 12, or a wall 150 of the chamber 30 enclosing the propellant cavity 31. By the time or position of contact, the sear rotator 142 has moved sufficiently rearward 119 to be completely free from any contact with the sear 120. The sear 120 is now free to rotate clockwise with the urging of the return spring 126. The sear 120 will thus move into the ready-to-fire position, recapturing the lip 130 of the bolt 40 as illustrated in FIG. 14E.

Figure 14C:
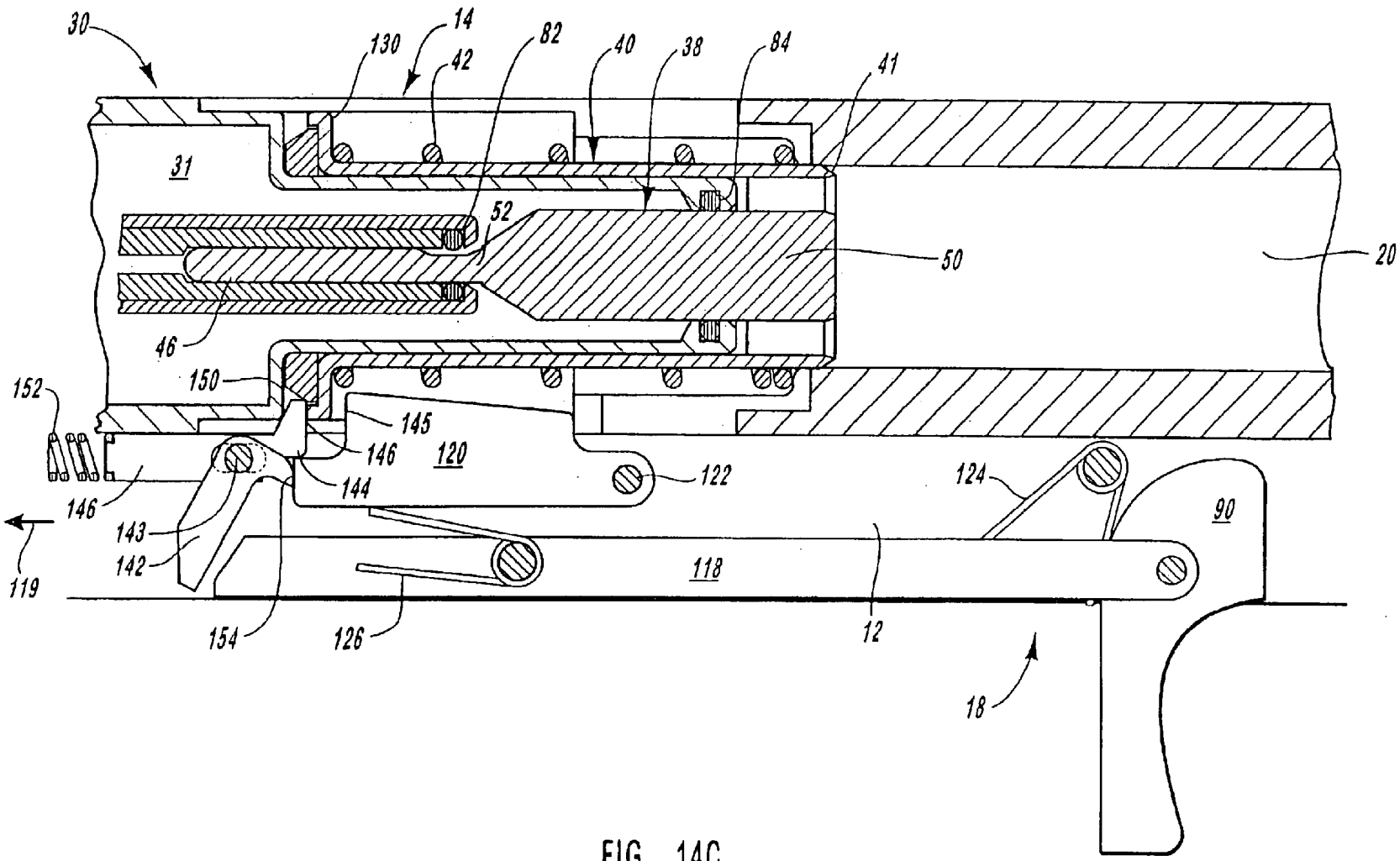
Figure 14D:
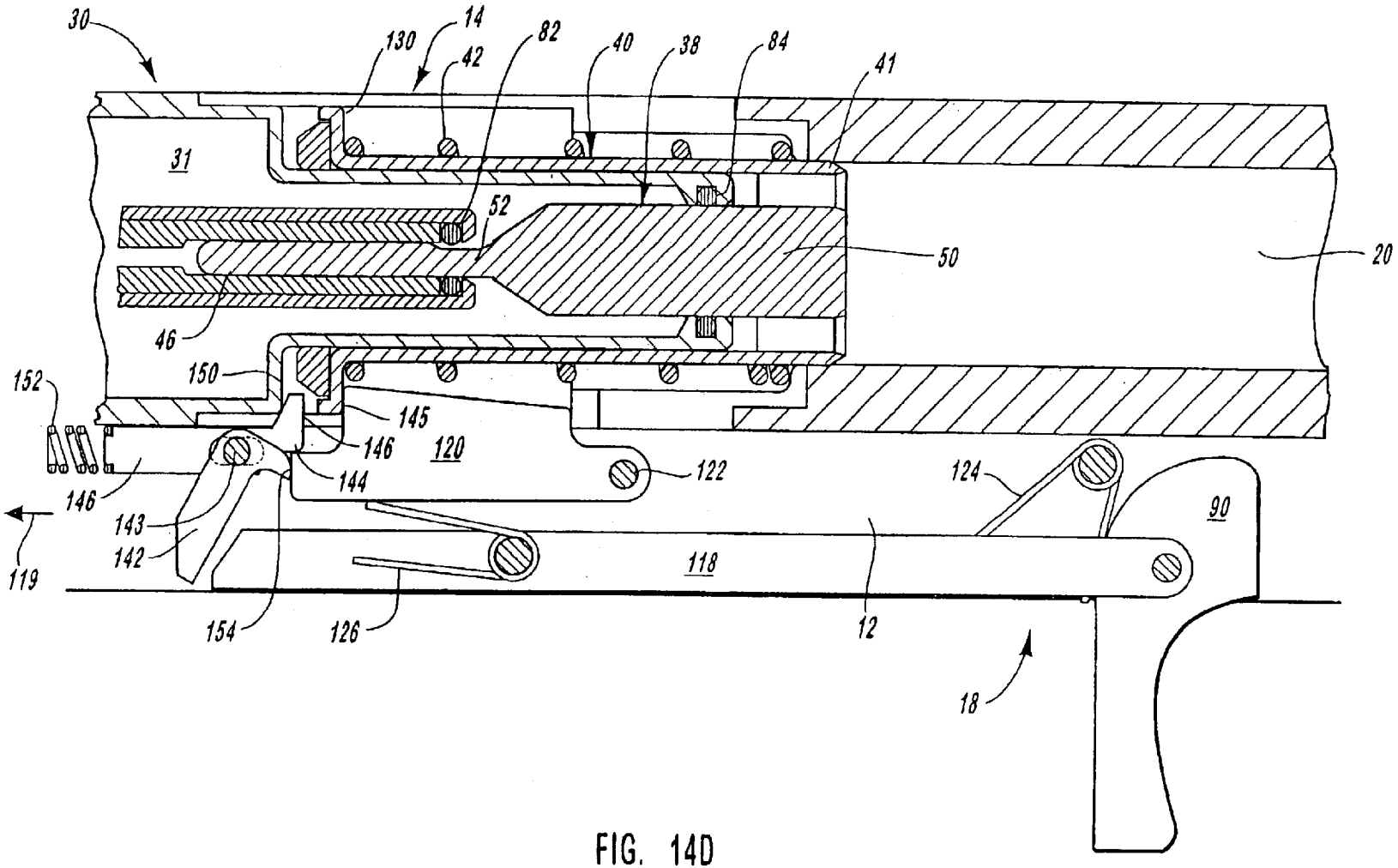
Figure 14E:
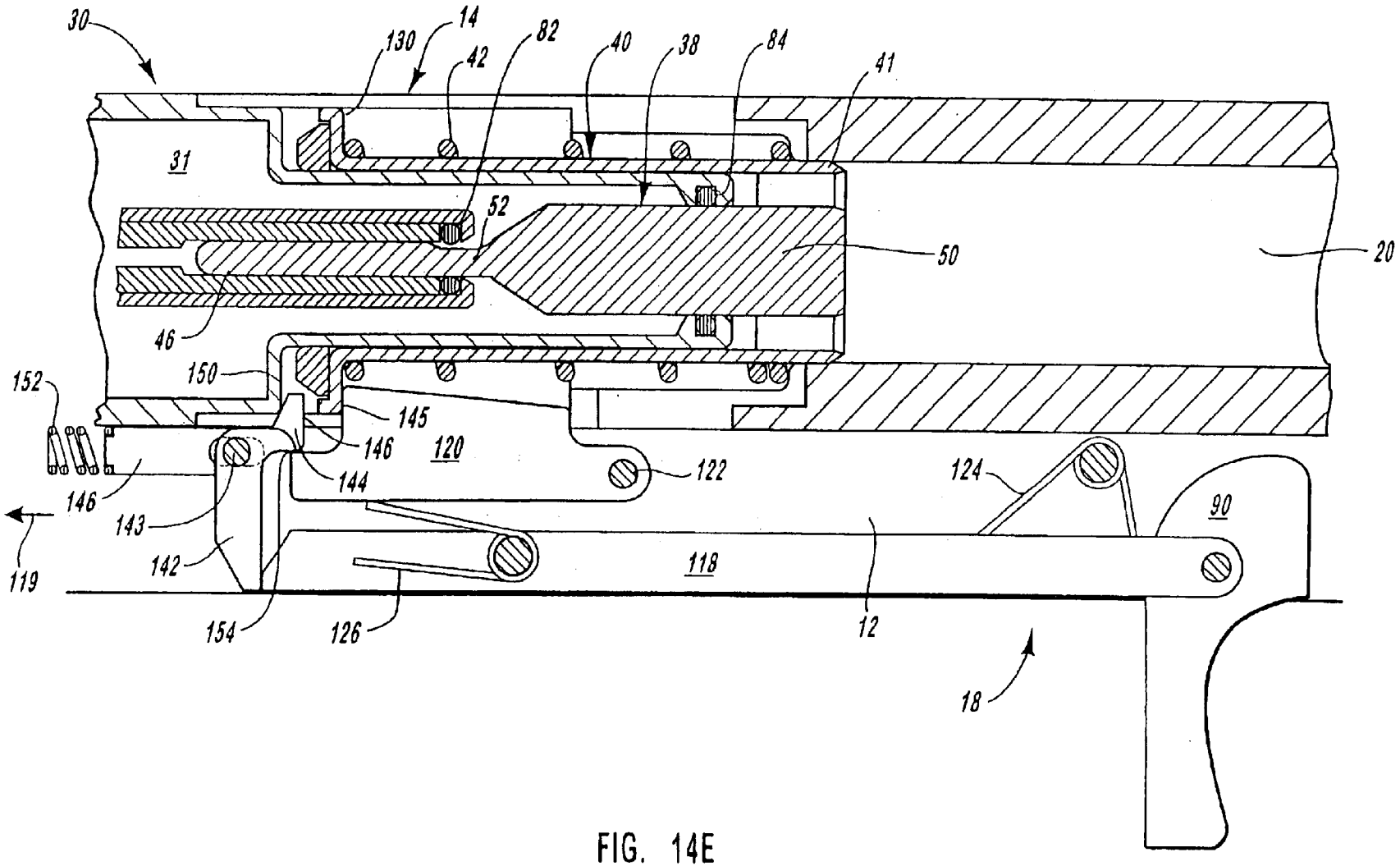
Figure 15:
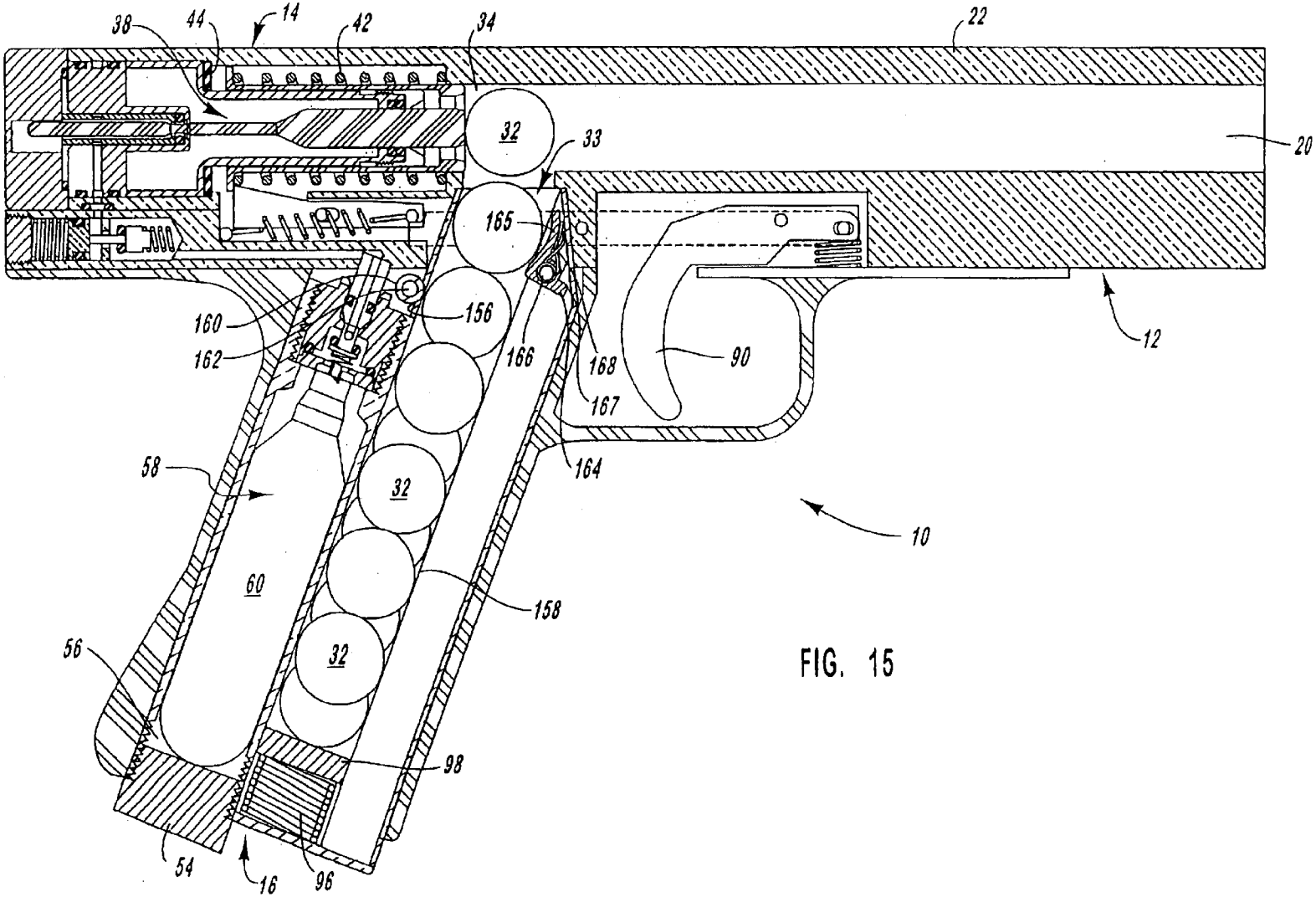
FIG. 15 is a side, elevation, cross-sectional view of an alternative embodiment of an action and magazine, trigger, barrel, and regulator for an apparatus and method in accordance with the invention.

As illustrated in FIGS. 14B–14D, the sear rotator 142 has a curved portion 154. As the sear rotator 142 moves forward, a curved portion 154 associated with the sear rotator 142 contacts the sear, rolling the sear rotator 142 counterclockwise into the final engagement position.

Referring to FIGS. 15–17A, while continuing to refer generally to FIGS. 1–17, certain alternative embodiments may provide additional features in an apparatus and method in accordance with the invention. For example, a magazine catch 156 may provide for ready release of a magazine 16 from the frame 12 of a gun 10. The magazine catch 156 may operate to release a magazine 16 in one embodiment. Alternatively, or additionally, the magazine catch 156 may serve to release only the ball chute portion 158 of the magazine 16 from the remainder of the magazine 16 containing the propellant 58. In one embodiment, a button 160 may operate with actuate the magazine catch 156. In certain embodiments, the magazine catch 156 may merely be a depression or detent that can interfere with or otherwise engage the button 160, selectively securing and releasing the ball chute 158 from the remainder of the magazine 16.

In certain embodiments, a spring 162 may urge the button 160 toward a secure position. Thus, actuation by a user may be a manual override by pushing the button 160 out of engagement with a magazine catch 156, releasing the ball chute 158, entire magazine 16, or the like.

In the embodiment of FIGS. 15–17B, an alternative embodiment for containing the projectiles 32 in the ball chute 158 may rely on a clip 164 or retainer 164. In one embodiment, the clip 164 has a portion there presenting a pocket 165 or depression 165 as the clip 164 rotates about a pin 166. Upon insertion into the gun 10, the clip 164 may be rotated about the pin 166 by a catch 167. The catch 167, associated with the gun 10, may operate by interference with complete insertion of the clip 164 or retainer 164. Accordingly, the catch 167 rotates the clip 164 clockwise against a return spring 168, releasing the projectiles 32 for insertion through the aperture 33 and into the chamber 34 of the gun 10.

A projectile 32 itself, once inserted into the projectile chamber 34, will restrain the column of projectiles 32 in the chute 158 against further delivery. During firing, the bolt head 41 obstructs the column of projectiles 32. Upon removal of the clip 16 or of the chute 158 of projectiles, the catch 167 releases the retainer 164 or clip 164, which then rotates the pocket 165 counterclockwise against the first projectile 32 in the chute 158. Thus, the projectiles 32 cannot be delivered from the chute 158 in the absence of the interfering catch 167 of the gun 10.

Figure 16:
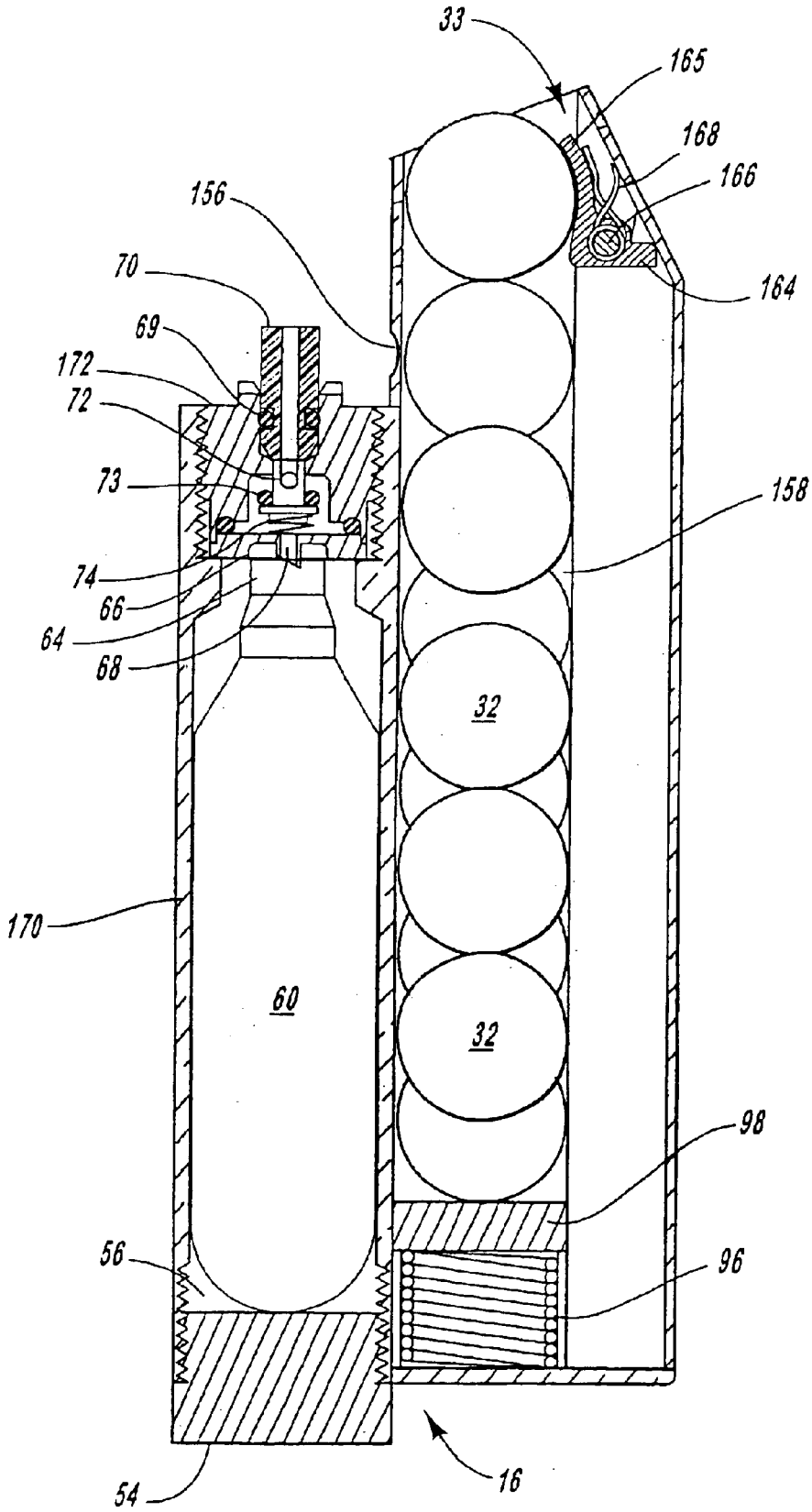
FIG. 16 is a side, elevation, cross-sectional view of the magazine of FIG. 15.

Referring to FIG. 16, while continuing to refer to FIGS. 1–17 generally, the magazine 16 may include various embodiments. In some embodiments, the activator 70 may be part of the magazine 16. In other embodiments, the activator 70 may be a part of the gun, engaging the poppet 72 of the magazine.

In any event, the alternative embodiment of FIG. 16 may rely on an independent housing 170 for the cartridge 60. However, in other embodiments, simple retention of the cartridge 60 with proper sealing by a seal 66 near the head 64 thereof may be sufficient. Likewise, manufacturing considerations may require a plug 172 for simplified assembly of the components associated with delivery and control of propellant 58 from the cartridge 60.

Figure 17A:
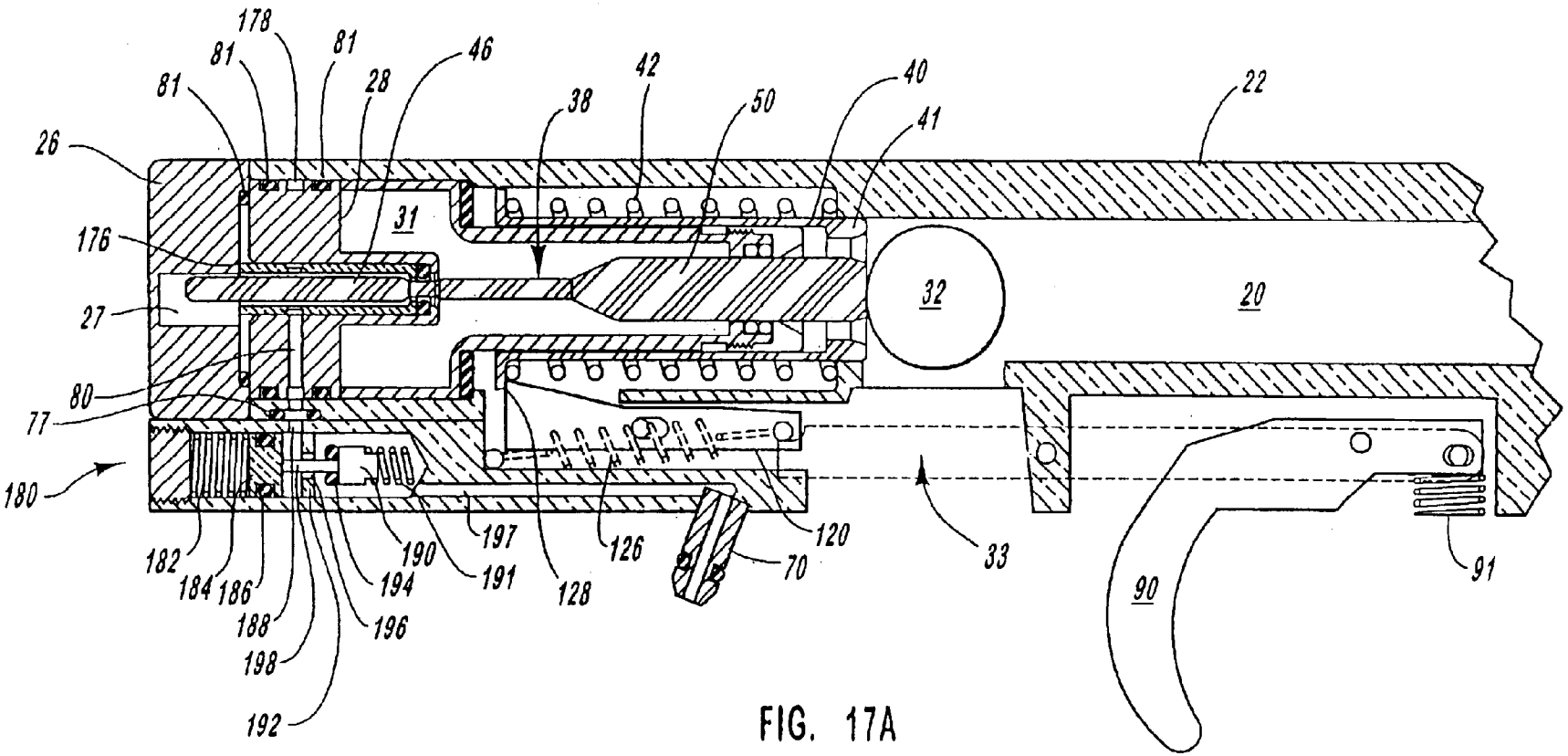
FIGS. 17A–17B are side, elevation, cross-sectional, partially-cutaway views of the action of FIG. 15 in a ready-to-fire position and a fired position, respectively.
Figure 17B:
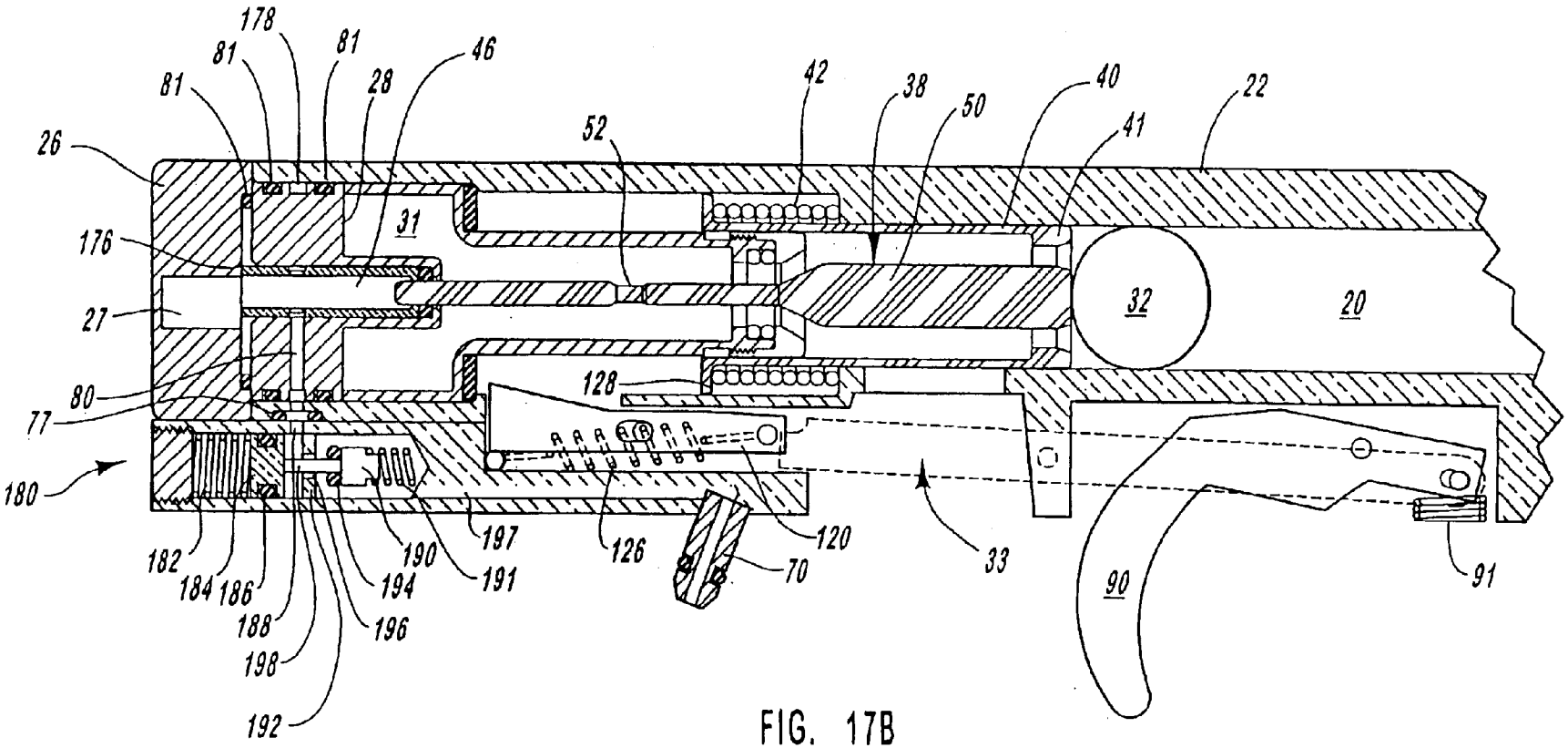

Referring to FIGS. 17A–17B, while continuing to refer generally to FIGS. 1–17, a regulated embodiment of a gun 10 in accordance with the invention may include several optional components. For example, a bushing 176 may provide a perforated path for supporting and guiding the tail shaft 46 of the actuator 38, while continuing to provide delivery of propellant 58 from the inlet 80 into the propellant chamber 31. An annular inlet 178 may circumnavigate the guide 28, sealed against escape of propellant 58.

In the embodiment of FIGS. 17A–17B, a regulator 180 may provide a regulated pressure to the propellant chamber 31. Thus, the propellant chamber 31 will not have such a wide variation in contained mass as temperature changes, or as the content of the cartridge 60 is dissipated.

In one embodiment, a spring 182 contacts a regulator plate 184, urging the plate 184 toward a base 192. A seal 186 maintains a propellant-proof contact for sealing the spring 182 away from the propellant 58. Thus, the outlet 188 is the only escape for propellant 58 introduced from the cartridge 60.

A poppet 190 may be activated by a spring 191, in opposition to the spring 182. The spring 191 urges the poppet 190 toward the base 192, where a seal 194 closes fluid communication between the poppet 190 and the outlet 188. A passage 196 through the base 192 communicates propellant from the poppet into the outlet 188.

Meanwhile, a passage 197 communicates propellant from the cartridge 60, and from the activator 70 to the poppet. A pin 198 of the poppet 190 contacts the plate 184. Accordingly, if the pressure of the poppet is sufficient that the plate 184 experiences sufficient force to move the spring 182 toward a pre-determined position, then the spring 182 compresses, the plate 184 moves (left in the illustration), as does the poppet 190, and its associated pin 198 moves through the passage 196 in the base 192, placing the seal 194 in contact with the base 192. Accordingly, the flow of propellant 158 ceases. Thus, the available pressure at the outlet 188 feeding the inlet 80 into the bushing 176 and the propellant chamber 31 assures more equal distribution of propellant 58 between various shots.

The bolt 40, comprising an actuator 38 and head 41 operates substantially as described hereinbefore. However, the geometries may alter in accordance with a designer's choice. Thus, greater or lesser numbers of components may be manufactured in order to accomplish all of the functionality. For example, the cavity 27 in the cap 26 of FIG. 17A seals against the guide 28. However, the guide 28 fits within the housing 22 of the gun 10. In other embodiments, the cap 26 and guide 28 may be aligned in sequence forming a portion of a housing 22 (see, e.g. FIG. 3).

From the above discussion, it will be appreciated that the present invention provides a paintball gun sized and designed to appear like and operate in a manner similar to a conventional gun. A dual-action firing bolt moves forward, assisting in launching a projectile, under cast pressure. The bolt then releases the compressed gas to carry the projectile down the barrel. Return springs operate to move the bolt and its valves to a ready-to-fire position. Similarly, trigger actuation mechanisms are spring-actuated to return to the ready-to-fire position. A removable magazine stores projectiles and propellant. The magazine is small enough to fit into a handle of a pistol. A user may selectively release just the projectile portion of the magazine, in order to leave the propellant undisturbed until fully expended. The magazine can be completely removed without substantial loss of propellant.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A gun comprising:

a frame for supporting the gun;

a plurality of spherical projectiles;

a magazine comprising a connector selectively attaching the magazine to the frame and a projectile store comprising an interior cavity having a width in the lateral direction effective to stagger the plurality of spherical projectiles placed therein and a retainer preventing the release of the plurality of spherical projectiles when the magazine is unattached to the frame, the projectile store further comprising an impeller to urge projectiles out of the interior cavity, the retainer being secured to the impeller to automatically secure the impeller to the interior cavity to resist travel of the impeller within the interior cavity upon detaching the magazine from the frame;

a barrel secured to the frame; and an action secured to the frame to control feeding of the plurality of spherical projectiles and propellant to the barrel.

2. The gun of claim 1, wherein the projectile store further comprises an impeller release positioned to release the retainer and free the impeller with respect to the chute when the magazine is attached to the frame.

3. The gun of claim 2, wherein:

the interior cavity defines longitudinal, lateral, and transverse directions substantially orthogonal to one another and has a proximal end spaced in the longitudinal direction from a distal end;

the interior cavity has an opening near the proximal end to release a projectile of the plurality of spherical projectiles from the projectile store; and the impeller is shaped to travel within the interior cavity and comprises a driving surface and a biasing member urging the driving surface toward the proximate end.

4. A gun comprising:

a frame for supporting the gun;

a plurality of spherical projectiles;

a magazine comprising a connector selectively attaching the magazine to the frame and a projectile store comprising an interior cavity having a width in the lateral direction effective to stagger the plurality of spherical projectiles placed therein and a retainer preventing the release of the plurality of spherical projectiles when the magazine is unattached to the frame, the magazine further comprising a propellant reservoir having a seal maintaining the reservoir sealed against the loss of propellant when the magazine is unattached to the frame;

a barrel secured to the frame; and an action secured to the frame to control feeding of the plurality of spherical projectiles and propellant to the barrel.

5. A gun comprising:

a frame;

a plurality of spherical projectiles;

a magazine selectively securing to the frame and comprising a projectile store and a quantity of propellant, the projectile store having an interior cavity containing the plurality of spherical projectiles and a retainer preventing the release of the plurality of spherical projectiles when the magazine is unattached to the frame, the projectile store further comprising an impeller to urge the plurality of spherical projectiles out of the interior cavity, the retainer being secured to the impeller to automatically secure the impeller to the interior cavity to resist travel of the impeller within the interior cavity upon detaching the magazine from the frame;

a barrel secured to the frame; and an action secured to the frame to control feeding of the plurality of spherical projectiles and quantity of propellant to the barrel.

6. The gun of claim 5, wherein the projectile store further comprises an impeller release positioned to release the retainer and free the impeller with respect to the chute when the magazine is attached to the frame.

7. The gun of claim 6, wherein:

the interior cavity defines longitudinal, lateral, and transverse directions substantially orthogonal to one another arid has a proximal end spaced in the longitudinal direction from a distal end;

the interior cavity has an opening near the proximal end to release a projectile of the plurality of spherical projectiles from the projectile store; and the impeller is shaped to travel within the interior cavity and comprises a driving surface and a biasing member urging the driving surface toward the proximate end.

8. A gun comprising:

a frame;

a plurality of spherical projectiles, each formed as a spherical shell filled with at least one of a liquid, gelatinous substance, and powder;

a magazine selectively securing to the frame and comprising a projectile store having an interior cavity containing the plurality of spherical projectiles, a retainer preventing the release of the plurality of spherical projectiles when the magazine is unattached to the frame, and a propellant reservoir containing propellant and having a seal maintaining the propellant reservoir sealed against the loss of propellant when the magazine is unattached to the fame;

a barrel secured to the frame;

an action secured to the frame to control feeding of the plurality of spherical projectiles and propellant to the barrel; and, the magazine, wherein the propellant reservoir is a canister containing carbon dioxide compressed to a saturated liquid.

9. A gun comprising:

a frame for supporting the gun;

a plurality of spherical projectiles;

a magazine comprising a connector selectively attaching the magazine to the frame and a projectile store defining an interior cavity containing the plurality of spherical projectiles, the projectile store having an impeller to urge the plurality of spherical projectiles out of the interior cavity and a retainer selectively fixing the impeller to the interior cavity to hinder the impeller from urging projectiles out of the interior cavity, the retainer having a release disengaging the retainer and freeing the impeller with respect to the interior cavity when the magazine attaches to the frame;

a barrel secured to the frame; and an action secured to the frame to control feeding of the selected projectiles and propellant to the barrel.

10. The gun of claim 9, wherein the retainer comprises a catch secured to the impeller and at least one receiver secured to the interior cavity for engaging the catch to resist travel of the impelled within the interior cavity.

11. The gun of claim 10, wherein the receiver comprises a groove formed in the interior cavity and wherein the catch comprises a tab secured to the impeller and sized to be selectively inserted into the groove.

12. The gun of claim 11, wherein the tab is homogeneously formed as part of the impeller.

13. The gun of claim 12, wherein the interior cavity has a width in the lateral direction effective to stagger the plurality of spherical projectiles of the placed therein.

14. The gun of claim 13, wherein each projectile of the plurality of spherical projectiles comprises a thin flexible shell filled with at least one of a liquid, a gelatinous substance, and a powder.

15. The gun of claim 14, wherein the magazine further comprises a propellant store comprising a propellant reservoir having a seal maintaining the reservoir sealed against the loss of propellant when the magazine is unattached to the frame.

16. A gun comprising:

a frame;

a barrel secured to the frame;

a magazine releasably secured to the frame and comprising a chute, propellant reservoir, and reservoir valve, the chute containing the plurality of projectiles each formed as a spherical shell filled with one of of a liquid, gelatinous substance, and powder, the reservoir valve resisting the release of a propellant contained within the propellant reservoir when the magazine is not secured to the frame;

an action controlling feeding of the plurality of projectiles and propellant into the barrel; and, the magazine, wherein the propellant reservoir is a canister containing carbon dioxide compressed to a saturated liquid.

17. The gun of claim 16, wherein the frame includes a handle oriented generally perpendicularly with respect to the barrel.

18. The gun of claim 17, wherein the magazine slides inside the handle to secure to the frame.

19. The gun of claims 18, wherein the plurality of projectiles comprises a plurality of paintballs.

20. The gun of claim 16, wherein the magazine further comprises an impeller urging the plurality of projectiles from the chute, a retainer resisting release of the plurality of projectiles from the chute when the magazine is not secured to the frame, a release disengaging the retainer when the magazine is secured to the frame.

* * * * *